US007890264B2

(12) United States Patent
Elphick

(10) Patent No.: US 7,890,264 B2
(45) Date of Patent: Feb. 15, 2011

(54) WATERFLOODING ANALYSIS IN A SUBTERRANEAN FORMATION

(75) Inventor: Jonathan Elphick, Cambridge (GB)

(73) Assignee: Schlumberger Technology Corporation, Houston, TX (US)

( * ) Notice: Subject to any disclaimer, the term of this patent is extended or adjusted under 35 U.S.C. 154(b) by 181 days.

(21) Appl. No.: 12/258,186

(22) Filed: Oct. 24, 2008

(65) Prior Publication Data

US 2009/0107669 A1 Apr. 30, 2009

Related U.S. Application Data

(60) Provisional application No. 60/982,656, filed on Oct. 25, 2007.

(51) Int. Cl.
*G01N 15/08* (2006.01)

(52) U.S. Cl. ..... 702/12; 702/6; 702/179; 166/250.07; 166/268; 73/152.39

(58) Field of Classification Search ..... 702/6, 702/9, 11, 12, 13, 179, 182; 166/254.1, 254.2, 166/250.1, 250.07, 250.15–250.17, 258, 166/252.1, 268, 275, 254.4, 245, 52; 703/2, 703/5, 9, 10; 73/152.39
See application file for complete search history.

(56) References Cited

U.S. PATENT DOCUMENTS 3,333,633 A * 8/1967 Greenkorn ..... 166/245
5,915,477 A * 6/1999 Stuebinger et al. ..... 166/245
6,002,985 A * 12/1999 Stephenson ..... 702/13
6,836,731 B1 * 12/2004 Whalley et al. ..... 702/13
7,066,254 B2 * 6/2006 Vinegar et al. ..... 166/245
2007/0143025 A1 * 6/2007 Valdez et al. ..... 702/13
2008/0262735 A1 * 10/2008 Thigpen et al. ..... 702/6

OTHER PUBLICATIONS

Chan, K. S., Water Control Diagnostic Plots, SPE Annual Technical Conference & Exhibition, Dallas, U.S.A., Oct. 22-25, 1995, pp. 755-763 (9 pages).
Dake, L. P., Fundamentals of Reservoir Engineering, Developments in Pertroleum Science 8, 2001, Introductory pages and pp. 115-119 (7 pages).
Dake, L. P., The Practice of Reservoir Engineering (Revised Edition), Developments in Petroleum Science 36, 2001, Introductory pages and pp. 336-355 (22 pages).
Willhite, G. P., Waterflooding, Third Printing, 1986 Title page and pp. 191-196 (7 pages).

* cited by examiner

*Primary Examiner*—Eliseo Ramos Feliciano
*Assistant Examiner*—Ricky Ngon
(74) *Attorney, Agent, or Firm*—Robert P. Lord; Bryan P. Galloway

(57) ABSTRACT

A method of analyzing a subterranean formation. The method includes specifying a volume of interest in the subterranean formation, specifying an injector wellsite that penetrates the volume of interest, specifying a first producer wellsite and a second producer wellsite, each of which penetrates the volume of interest, calculating a first Injectivity-Productivity Index (IPI) for a first injector-producer wellsite pair which includes the injector wellsite and the first producer wellsite, calculating a second IPI for a second injector-producer wellsite pair which includes the injector wellsite and the second producer wellsite, determining whether the first IPI is substantially equal to the second IPI to obtain an analysis result, and adjusting a wellsite operation based on the analysis result.

20 Claims, 15 Drawing Sheets

WATERFLOODING ANALYSIS IN A SUBTERRANEAN FORMATION

CROSS REFERENCE TO RELATED APPLICATION

This application claims priority pursuant to 35 U.S.C. §119 (e), to the filing date of U.S. patent application Ser. No. 60/982,656 entitled "SYSTEM AND METHOD FOR PERFORMING OILFIELD OPERATIONS," filed on Oct. 25, 2007, which is hereby incorporated by reference in its entirety.

BACKGROUND

Wellsite operations, such as surveying, drilling, wireline testing, completions, simulation, planning and oilfield analysis, are typically performed to locate and gather valuable downhole fluids. Various aspects of the oilfield and its related operations are shown in FIGS. 1A-1D. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present, and if they are reasonably accessible.

As shown in FIG. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing.

After the drilling operation is complete, the well may then be prepared for production. As shown in FIG. 1D, wellbore completions equipment is deployed into the wellbore to complete the well in preparation for the production of fluid therethrough. Fluid is then drawn from downhole reservoirs, into the wellbore and flows to the surface. Production facilities are positioned at surface locations to collect the hydrocarbons from the wellsite(s). Fluid drawn from the subterranean reservoir(s) passes to the production facilities via transport mechanisms, such as tubing. Various equipment may be positioned about the oilfield to monitor oilfield parameters and/or to manipulate the wellsite operations.

A common method of increasing production in an oilfield is through injection of water (or other fluids) into a reservoir (or more specifically, an injection well within the reservoir). The injected water is used to displace the hydrocarbons in the reservoir. The injected water typically induces the hydrocarbons to flow towards a production well, through which hydrocarbons are drawn to the surface.

Due to the complex nature of the subterranean reservoir(s), methods have been developed to determine the optimal manner in which water (or other fluids) are injected into the reservoir.

SUMMARY

In general, in one aspect, the invention relates to a method of analyzing a subterranean formation. The method steps include specifying a volume of interest in the subterranean formation, specifying an injector wellsite, which penetrates the volume of interest, specifying a first producer wellsite and a second producer wellsite, each of which penetrates the volume of interest, calculating a first Injectivity-Productivity Index (IPI) for a first injector-producer wellsite pair which includes the injector wellsite and the first producer wellsite, calculating a second IPI for a second injector-producer wellsite pair which includes the injector wellsite and the second producer wellsite, determining whether the first IPI is substantially equal to the second IPI to obtain an analysis result, and adjusting a wellsite operation based on the analysis result.

In general, in one aspect, the invention relates to a method of analyzing a subterranean formation. The method steps include specifying a volume of interest in the subterranean formation, specifying an injector wellsite, which penetrates the volume of interest, specifying a producer wellsite, which penetrates the volume of interest, calculating a first Injectivity-Productivity Index (IPI) for a first layer between the injector wellsite and the producer wellsite, calculating a second IPI for a second layer between the injector wellsite and the producer wellsite, determining whether the difference between the first IPI and the second IPI is less than a threshold value, and adjusting at least one selected from a group consisting of a downhole pressure and a flow rate between the injector wellsite and the producer wellsite for the first layer when the difference between the first IPI and the second IPI is less than the threshold value.

In general, in one aspect, the invention relates to a surface unit for analyzing a subterranean formation. The surface unit includes a repository for storing data obtained from the subterranean formation and data of a producer wellsite, a first injector wellsite, and a second injector wellsite, and memory having stored instructions when executed by a processor comprising functionalities to specify a volume of interest in the subterranean formation, specify the producer wellsite penetrating the volume of interest, wherein specifying the producer wellsite is based on at least a first portion of the data, specify the first injector wellsite and the second injector wellsite, each of which penetrating the volume of interest, wherein specifying the first injector wellsite and the second injector wellsite is based on at least a second portion of the data, calculate a first Injectivity-Productivity Index (IPI) for a first injector-producer wellsite pair which includes the first injector wellsite and the producer wellsite, calculate a second IPI for a second injector-producer wellsite pair which includes the second injector wellsite and the producer wellsite, determine whether the first IPI is substantially equal to the second IPI to obtain a first analysis result, and perform a first wellsite operation based on the first analysis result.

Other aspects of the invention will be apparent from the following description and the appended claims.

DETAILED DESCRIPTION

Figure 1A:
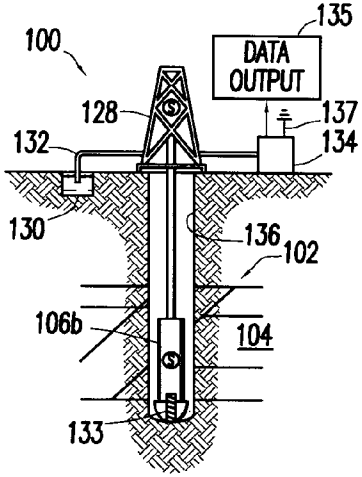
FIGS. 1A-1D depict exemplary schematic views of an oilfield having subterranean structures including reservoirs therein and various wellsite operations being performed on the oilfield.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention are directed to analyzing waterflooding in a reservoir and determining how to adjust the wellsite operations in the reservoir based on the analysis. More specifically, embodiments of the invention are directed to using an Injectivity-Productivity Index (IPI) to characterize the flow of water (or other injected fluids) from an injector wellsite(s) to a producer wellsite(s). Based on the distribution of IPI values from a given injector wellsite and/or producer wellsite, a determination may be made about how to modify the wellsite operations at the injector wellsite and/or producer wellsite in order to increase/optimize vertical sweep (i.e., distribution of flowlines in the vertical direction) and/or areal sweep (i.e., distribution of flowlines in the areal direction along the formation layer). In one embodiment of the invention, the IPI values are used to improve sweep in low mobility reservoirs (e.g., reservoirs with an end-point mobility ratio above 1).

FIGS. 1A-D depict an oilfield (100) having geological structures and/or subterranean formations therein. As shown in these figures, various measurements of the subterranean formation may be obtained using different tools at the same location. These measurements may be used to generate information about the formation and/or the geological structures and/or fluids contained therein.

FIGS. 1A-1D depict schematic views of an oilfield (100) having subterranean formations (102) containing a reservoir (104) therein and depicting various wellsite operations being performed on the oilfield (100). FIG. 1A depicts a survey operation being performed by a seismic truck (106*a*) to measure properties of the subterranean formation. The survey operation is a seismic survey operation for producing sound vibration(s) (112). In FIG. 1A, one such sound vibration (112) is generated by a source (110) and reflects off a plurality of horizons (114) in an earth formation (116). The sound vibration(s) (112) is (are) received in by sensors (S), such as geophone-receivers (118), situated on the earth's surface, and the geophone-receivers (118) produce electrical output signals, referred to as data received (120) in FIG. 1A.

In response to the received sound vibration(s) (112) representative of different parameters (such as amplitude and/or frequency) of the sound vibration(s) (112). The data received (120) is provided as input data to a computer (122*a*) of the seismic recording truck (106*a*), and responsive to the input data, the recording truck computer (122*a*) generates a seismic data output record (124). The seismic data may be further processed as desired, for example by data reduction.

Figure 1B:
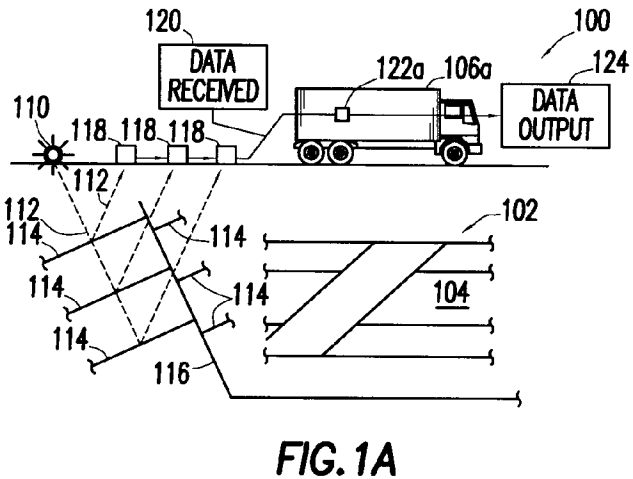

FIG. 1B depicts a drilling operation being performed by a drilling tool (106*b*) suspended by a rig (128) and advanced into the subterranean formation (102) to form a wellbore (136). A mud pit (130) is used to draw drilling mud into the drilling tool (106*b*) via flow line (132). The drilling mud is subsequently for circulated through the drilling tool (106*b*) and back to the surface. The drilling tool (106*b*) is advanced into the formation to reach reservoir (104). The drilling tool (106*b*) is preferably adapted for measuring downhole properties. The drilling tool (106*b*) may also be adapted for taking a core sample (133) as shown, or may be removed and replaced with another tool which is adapted to take the core sample (133).

A surface unit (134) is used to communicate with the drilling tool (106*b*) and offsite operations. The surface unit (134) is capable of communicating with the drilling tool (106*b*) to send commands to drive the drilling tool (106*b*), and to receive data therefrom. The surface unit (134) is preferably provided with computer facilities for receiving, storing, processing, and analyzing data from the oilfield (100). The surface unit (134) collects data output (135) generated during the drilling operation. Computer facilities, such as those of the surface unit (134), may be positioned at various locations about the oilfield (100) and/or at remote locations.

Sensors (S), such as gauges, may be positioned throughout the reservoir, rig, oilfield equipment (such as the downhole tool), or other portions of the oilfield for gathering information about various parameters, such as surface parameters, downhole parameters, and/or operating conditions. These sensors (S) preferably measure oilfield parameters, such as weight on bit, torque on bit, pressures, temperatures, flow rates, compositions and other parameters of the wellsite operation.

The information gathered by the sensors (S) may be collected by the surface unit (134) and/or other data collection sources for analysis or other processing. The data collected by the sensors (S) may be used alone or in combination with other data. The data may be collected in a database and all or select portions of the data may be selectively used for analyzing and/or predicting wellsite operations of the current and/or other wellbores.

Data outputs from the various sensors (S) positioned about the oilfield may be processed for use. The data may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, reservoir engineering, and/or production simulations. The reservoir, wellbore, surface and/or process data may be used to perform reservoir, wellbore, or other production simulations. The data outputs from the wellsite operation may be generated directly from the sensors (S), or after some preprocessing or modeling. These data outputs may act as inputs for further analysis.

The data is collected and stored at the surface unit (134). One or more surface units (134) may be located at the oilfield (100), or linked remotely thereto. The surface unit (134) may be a single unit, or a complex network of units used to perform the necessary data management functions throughout the oilfield (100). The surface unit (134) may be a manual or automatic system. The surface unit (134) may be operated and/or adjusted by a user.

The surface unit (134) may be provided with a transceiver (137) to allow communications between the surface unit (134) and various portions (or regions) of the oilfield (100) or other locations. The surface unit (134) may also be provided with or functionally linked to a controller for actuating mechanisms at the oilfield (100). The surface unit (134) may then send command signals to the oilfield (100) in response to data received. The surface unit (134) may receive commands via the transceiver or may itself execute commands to the controller. A processor may be provided to analyze the data (locally or remotely) and make the decisions to actuate the controller. In this manner, the oilfield (100) may be selectively adjusted based on the data collected to optimize fluid recovery rates, or to maximize the longevity of the reservoir (104) and its ultimate production capacity. These adjustments may be made automatically based on computer protocol, or manually by an operator. In some cases, well plans may be adjusted to select optimum operating conditions, or to avoid problems.

Figure 1C:
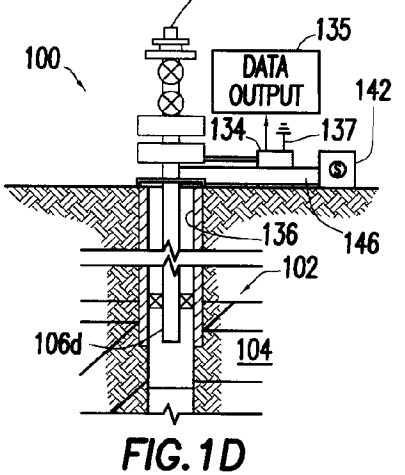

FIG. 1C depicts a wireline operation being performed by a wireline tool (106*c*) suspended by the rig (128) and into the wellbore (136) of FIG. 1B. The wireline tool (106*c*) is preferably adapted for deployment into a wellbore (136) for performing well logs, performing downhole tests and/or collecting samples. The wireline tool (106*c*) may be used to provide another method and apparatus for performing a seismic survey operation. The wireline tool (106*c*) of FIG. 1C may have an explosive or acoustic energy source (143) that provides electrical signals to the surrounding subterranean formations (102).

The wireline tool (106*c*) may be operatively linked to, for example, the geophones (118) stored in the computer (122*a*) of the seismic recording truck (106*a*) of FIG. 1A. The wireline tool (106*c*) may also provide data to the surface unit (134). As shown, data output (135) is generated by the wireline tool (106*c*) and collected at the surface. The wireline tool (106*c*) may be positioned at various depths in the wellbore (136) to provide a survey of the subterranean formation.

Figure 1D:
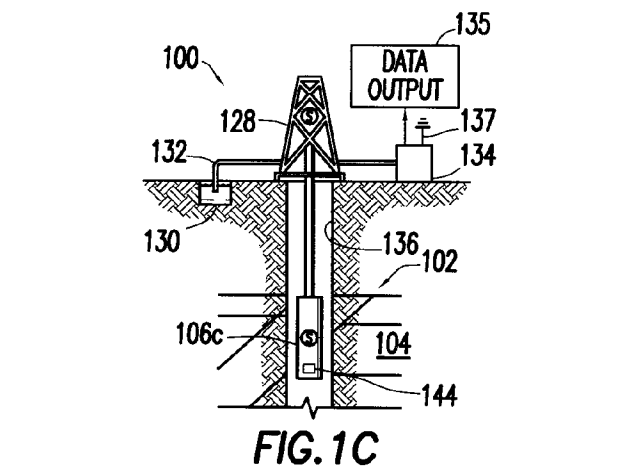

FIG. 1D depicts a production operation being performed by a production tool (106*d*) deployed from a production unit or christmas tree (129) and into the completed wellbore (136) of FIG. 1C for drawing fluid from the downhole reservoirs into surface facilities (142). Fluid flows from reservoir (104) through perforations in the casing (not shown) and into the production tool (106*d*) in the wellbore (136) and to the surface facilities (142) via a gathering network (146). Sensors (S) positioned about the oilfield (100) are operatively connected to a surface unit (134) for collecting data therefrom. During the production process, data output (135) may be collected from various sensors (S) and passed to the surface unit (134) and/or processing facilities. This data may be, for example, reservoir data, wellbore data, surface data and/or process data. As shown, the sensor (S) may be positioned in the production tool (106*d*) or associated equipment, such as the Christmas tree, gathering network, surface facilities (142) and/or the production facility, to measure fluid parameters, such as fluid composition, flow rates, pressures, temperatures, and/or other parameters of the production operation.

While FIGS. 1A-1D depict monitoring tools used to measure properties of an oilfield (100), it will be appreciated that the tools may be used in connection with non-wellsite operations, such as mines, aquifers or other subterranean facilities. Also, while certain data acquisition tools are depicted, it will be appreciated that various measurement tools capable of sensing properties, such as seismic two-way travel time, density, resistivity, production rate, etc., of the subterranean formation and/or its geological structures may be used. Various sensors (S) may be located at various positions along the subterranean formation and/or the monitoring tools to collect and/or monitor the desired data. Other sources of data may also be provided from offsite locations.

The oilfield configuration in FIGS. 1A-1D is not intended to limit the scope of the invention. Part, or all, of the oilfield (100) may be on land and/or sea. Also, while a single oilfield at a single location is depicted, the present invention may be used with any combination of one or more oilfields (100), one or more processing facilities and one or more wellsites. Additionally, while only one wellsite is shown, it will be appreciated that the oilfield (100) may cover a portion of land that hosts one or more wellsites. One or more gathering facilities may be operatively connected to one or more of the wellsites for selectively collecting downhole fluids from the wellsite (s).

Figure 2:
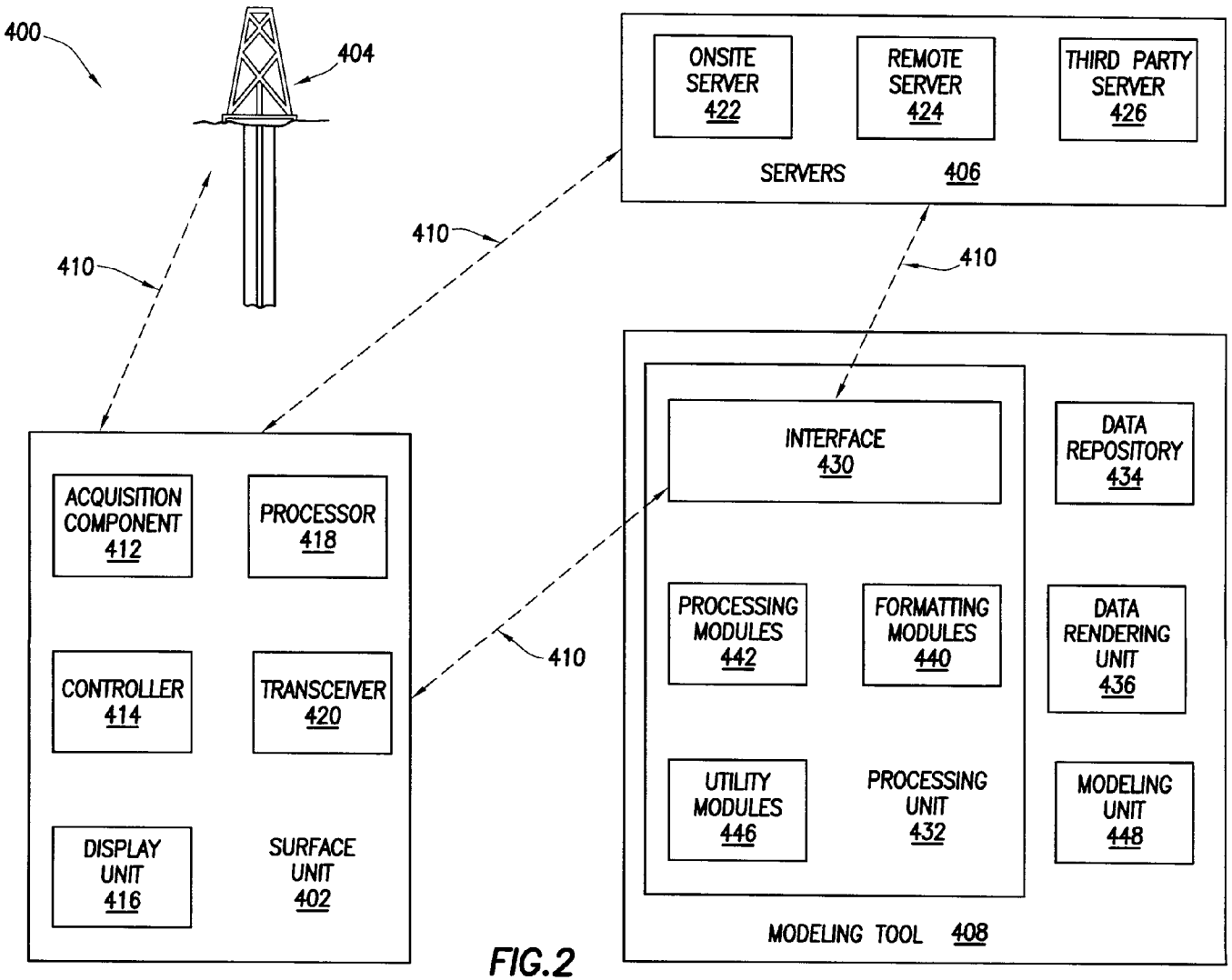
FIG. 2 shows a schematic diagram of a system for performing wellsite operations of an oilfield.

FIG. 2 is a schematic view of a system (400) for performing wellsite operations. As shown, the system (400) includes a surface unit (402) operatively connected to a wellsite (404), servers (406) operatively linked to the surface unit (402), and a modeling tool (408) operatively linked to the servers (406). As shown, communication links (410) are provided between the wellsite (404), surface unit (402), servers (406), and modeling tool (408). A variety of links may be provided to facilitate the flow of data through the system. For example, the communication links (410) may provide for continuous, intermittent, one-way, two-way and/or selective communication throughout the system (400). The communication links (410) may be of any type, such as wired, wireless, etc.

The surface unit (402) is preferably provided with an acquisition component (412), a controller (414), a display unit (416), a processor (418) and a transceiver (420). The acquisition component (412) is configured to collect and/or store data of the oilfield. This data may be data measured by the sensors (S) of the wellsite as described with respect to FIGS. 1A-1D. This data may also be data received from other sources.

The controller (414) is enabled to enact commands at the oilfield. The controller (414) may be provided with actuation means to perform drilling operations, such as steering, advancing, or otherwise taking action at the wellsite. Commands may be generated based on logic of the processor (418), or by commands received from other sources. The processor (418) includes functionality to manipulate and/or analyze the data. The processor (418) may also include functionality to perform wellsite operations.

A display unit (416) may be provided at the wellsite and/or remote locations for viewing oilfield data (not shown). The oilfield data represented by a display unit (416) may be raw data, processed data and/or data outputs generated from various data. The display unit (416) is may be adapted to provide flexible views of the data, such that the screens depicted may be customized as desired. A user may plan, adjust, and/or otherwise perform wellsite operations (e.g., determine the desired course of action during drilling) based on reviewing the displayed oilfield data. The wellsite operations may be selectively adjusted in response to viewing the data on the display unit (416). The display unit (416) may include a two-dimensional (2D) display or a three-dimensional (3D) display for viewing oilfield data or various aspects of the wellsite operations.

The transceiver (420) includes functionality to provide data access to and/or from other sources. The transceiver (420) may also include functionality to communicate with other components, such as the servers (406), the wellsite (404), surface unit (402), and/or the modeling tool (408).

The servers (406) may be used to transfer data from one or more wellsites to the modeling tool (408). As shown, the servers (406) include an onsite server (422), a remote server (424), and a third party server (426). The onsite server (422) may be positioned at the wellsite and/or other locations for distributing data from the surface unit. The remote server (424) is positioned at a location away from the oilfield and provides data from remote sources. The third party server (426) may be onsite or remote, but is operated by a third party, such as a client.

The servers (406) may include functionality to transfer drilling data, such as logs, drilling events, trajectory, and/or other oilfield data, such as seismic data, historical data, economics data, or other data that may be of use during analysis. The type of server is not intended to limit the invention. Those skilled in the art will appreciate that the system may be adapted to function with any type of server that may be employed.

The servers (406) are configured communicate with the modeling tool (408) as indicated by the communication links (410). As indicated by the multiple arrows, the servers (406) may have separate communication links (410) with the modeling tool (408). One or more of the servers (406) may be combined or linked to provide a combined communication link (410).

The servers (406) may be configured to collect a wide variety of data. The data may be collected from a variety of channels that provide a certain type of data, such as well logs. The data from the servers is passed to the modeling tool (408) for processing. The servers (406) may also be used to store and/or transfer data.

The modeling tool (408) is operatively linked to the surface unit (402) for receiving data therefrom. In some cases, the modeling tool (408) and/or server(s) (406) may be positioned at the wellsite. The modeling tool (408) and/or server(s) (406) may also be positioned at various locations. The modeling tool (408) may be operatively linked to the surface unit via the server(s) (406). The modeling tool (408) may also be included in or located near the surface unit (402).

The modeling tool (408) includes an interface (430), a processing unit (432), a modeling unit (448), a data repository (434) and a data rendering unit (436). The interface (430) is configured to communicate with other components, such as the servers (406). The interface (430) may also permit communication with other oilfield or non-oilfield sources. The interface (430) receives the data and maps the data for processing. Data from servers (406) typically streams along predefined channels, which may be selected by the interface (430).

As depicted in FIG. 2, the interface (430) is configured to select the data channel of the server(s) (406) and receive the corresponding data. The interface (430) may also be configured to map the data channels to data from the wellsite. The data may then be passed to the processing modules (442) of the modeling tool (408). In some implementations, the data is immediately incorporated into the modeling tool (408) for real-time sessions or modeling. The interface (430) may also be configured to create data requests, displays the user interface, and handles connection state events. Further, the interface (430) may be configured to instantiates the data into a data object for processing.

The processing unit (432) includes formatting modules (440), processing modules (442), and utility modules (446). These modules may include functionality to manipulate the oilfield data for real-time analysis. The formatting modules (440) may include functionality to convert (or otherwise modify) the data to place it in a desired format for processing. For example, incoming data may need to be formatted, translated, converted or otherwise manipulated for use. The formatting modules (440) may also be configured to enable the data from a variety of sources to be formatted and used so that the data processes and displays in real time.

The utility modules (446) include functionality to support one or more functions of the drilling system. The utility modules (446) include the logging component (not shown) and the user interface (UI) manager component (not shown). The logging component provides a common call for all logging data. This module allows the logging destination to be set by the application. The logging component may also include other features, such as a debugger, a messenger, and a warning system, among others. The debugger is configured to sends a debug message to those using the system. The messenger sends information to subsystems, users, and others. The information may or may not interrupt the operation and may be distributed to various locations and/or users throughout the system. The warning system may be used to send error messages and warnings to various locations and/or users throughout the system. In some cases, the warning messages may interrupt the process and display alerts.

The UI manager component creates user interface elements for displays. The UI manager component defines user input screens, such as menu items, context menus, toolbars, and settings windows. The UI manager may also be used to handle events relating to these user input screens.

The processing module (442) may include functionality to analyze the data and generate outputs. As described above, the data may include static data, dynamic data, historic data, real-time data, or other types of data. Further, the data may relate to various aspects of the wellsite operations, such as formation structure, geological stratigraphy, core sampling, well logging, density, resistivity, fluid composition, flow rate, downhole condition, surface condition, equipment condition, or other aspects of the wellsite operations.

The data repository (434) may be configured to store the data for the modeling unit (448). The data is preferably stored in a format available for use in real-time (e.g., information is updated at approximately the same rate the information is received). The data is generally passed to the data repository (434) from the processing modules (442). The data may be persisted in the file system (e.g., as an extensible markup language (XML) file) or in a database. The system determines which storage is the most appropriate to use for a given piece of data and stores the data in a manner to enable automatic flow of the data through the rest of the system in a seamless and integrated fashion. The system also facilitates manual and automated workflows (such as Modeling, Geological & Geophysical workflows) based upon the persisted data.

The data rendering unit (436) performs rendering algorithm calculation to provide one or more displays for visualizing the data. The displays may be presented to a user at the display unit (416). The data rendering unit (436) may selectively provide displays composed of any combination of one or more canvases. The canvases may or may not be synchronized with each other during display. The data rendering unit (436) may include mechanisms for actuating various canvases or other functions in the system. The modeling tool (408) performs modeling functions for generating complex oilfield outputs such as modeling waterflooding in a reservoir to determine how to adjust the wellsite operations accordingly.

While specific components are depicted and/or described for use in the units and/or modules of the modeling tool (408), it will be appreciated that a variety of components with various functions may be used to provide the formatting, processing, utility and coordination functions necessary to provide processing in the modeling tool (408). The components may have combined functionalities and may be implemented as software, hardware, firmware, or combinations thereof.

Further, components (e.g., the processing modules (442) and the data rendering unit (436)) of the modeling tool (408) may be located in an onsite server (422) or in distributed locations where remote server (424) and/or third party server (426) may be involved. The onsite server (422) may be located within the surface unit (402).

Figure 3A:
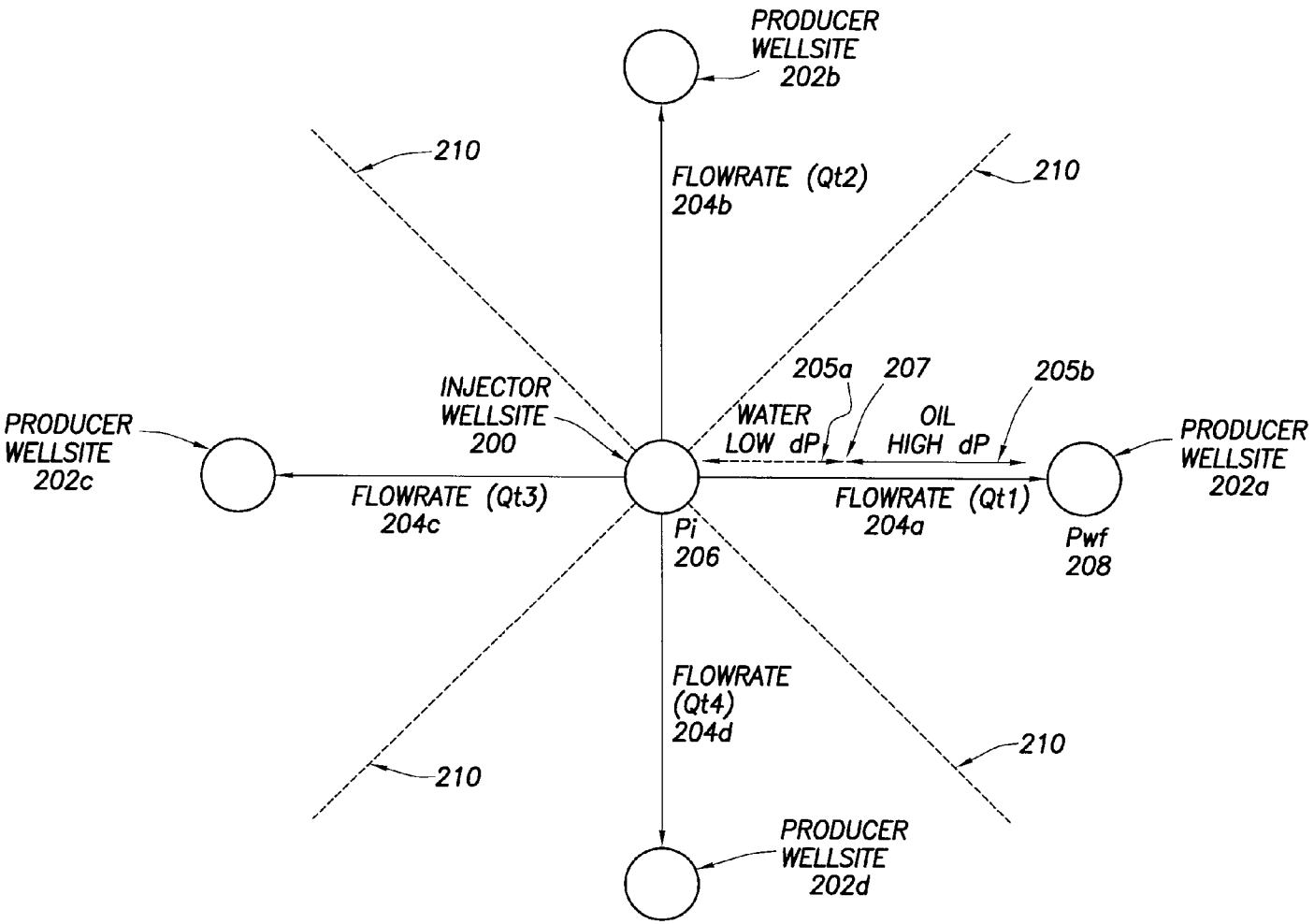
FIG. 3A shows injector-producer pairs in accordance with one or more embodiments of the invention.

As discussed above, embodiments of the invention relate to modeling and analysis of waterflooding using IPI. In one embodiment of the invention, IPI is determined on a per injector-producer wellsite pair basis. FIG. 3A shows a five spot pattern between an injector wellsite (200) and four producer wellsites (202*a*-202*d*) in accordance with one or more embodiments of the invention. As shown in FIG. 3A, an injector-producer wellsite pair includes the injector wellsite (200) in which fluids, such as water, are injected and a producer wellsite (202*a*-202*d*) from which fluids are produced. The fluids from the injector wellsite (200) flow through the reservoir (depicted by the directional arrow or streamline (204*a*)) towards the producer wellsite (202*a*). In the process, the injected fluids displace the hydrocarbons (e.g., oil) in the reservoir. The displaced hydrocarbons ideally flow to the producer wellsite (202*a*), through which they are subsequently extracted. Further as shown in FIG. 3A, each of the producer wellsites (202*b*)-(202*d*) forms an injector-producer wellsite pair with the injector wellsite (200) and collects fluid from the injector wellsite (200) flowing through the reservoir in a similar fashion as depicted by the streamlines (204*b*)-(204*d*). In one embodiment of the invention, the total fluid flow induced by the fluid injection from the injector wellsite (200) may be considered uniform and divided into four portions, defined by dash lines (210), to be collected by the four producer wellsites (202*a*-202*d*), respectively.

The efficiency with which the injected fluids displace the trapped hydrocarbons from the reservoir may be measured using vertical sweep efficiency and/or areal sweep efficiency. In one embodiment of the invention, in order to increase and/or maximize the vertical sweep and/or areal sweep of the given volume (i.e., in order to maximize the amount of hydrocarbons displaced by the injected fluids), the IPI value for each injector-producer wellsite pair may be determined.

In one embodiment of the invention, IPI value is calculated using the following equation $$IPI = \frac{Q_i}{(P_i - P_{wf})}, \qquad \text{(Equation 1)}$$

where $P_i$ (206) is the bottom hole pressure of the injector wellsite, $P_{wf}$ (208*a*) is the bottom hole pressure of the producer wellsite (202*a*), and $Q_t$ (204*a*) is the total flow of injected fluid between the injector wellsite (200) and the producer wellsite (202*a*). In one embodiment of the invention, the aforementioned values required to calculate IPI may be obtained directly or indirectly using, for example, downhole tools and/or any other well known equipment and techniques. In one embodiment of the invention, iterative procedures and/or integration may be used to determine IPI, $Q_t$ and F. Further, in one embodiment of the invention, a method may be used to simultaneously solve IPI, Qt, and/or F for multiple pairs of wells in multiple patterns. Further, in scenarios in which there may be insufficient equations of flow to determine the flow rates (Qt) between all injector-producer pairs, one or more well tests may be performed and/or historical data used to determine historical changes in rates and corresponding pressures. This additional information may then be used to solve the system (i.e., the multiple injector-producers pairs).

Returning to FIG. 3A, considering fluid flow for each injector-producer wellsite pair in one dimension, if piston-like displacement occurs along the streamline (204*a*) representing the fluid flow, then a low pressure drop in the part of the stream line (205*a*) nearest to the injector wellsite (200) occupied by high mobility injected fluid (e.g., water) plus a high pressure drop in the remaining part of the streamline (205*b*) still occupied by low mobility oil is observed. As the flood front (207) approaches the producer wellsite (202*a*), most of the pressure drop is occurring over a shorter length of the streamline (205*b*) causing an increasing pressure gradient near the producer wellsite (202*a*). This may contribute to single-grain or tensile failure causing sand production when, and even before, water breakthrough occurs.

Figure 3B:
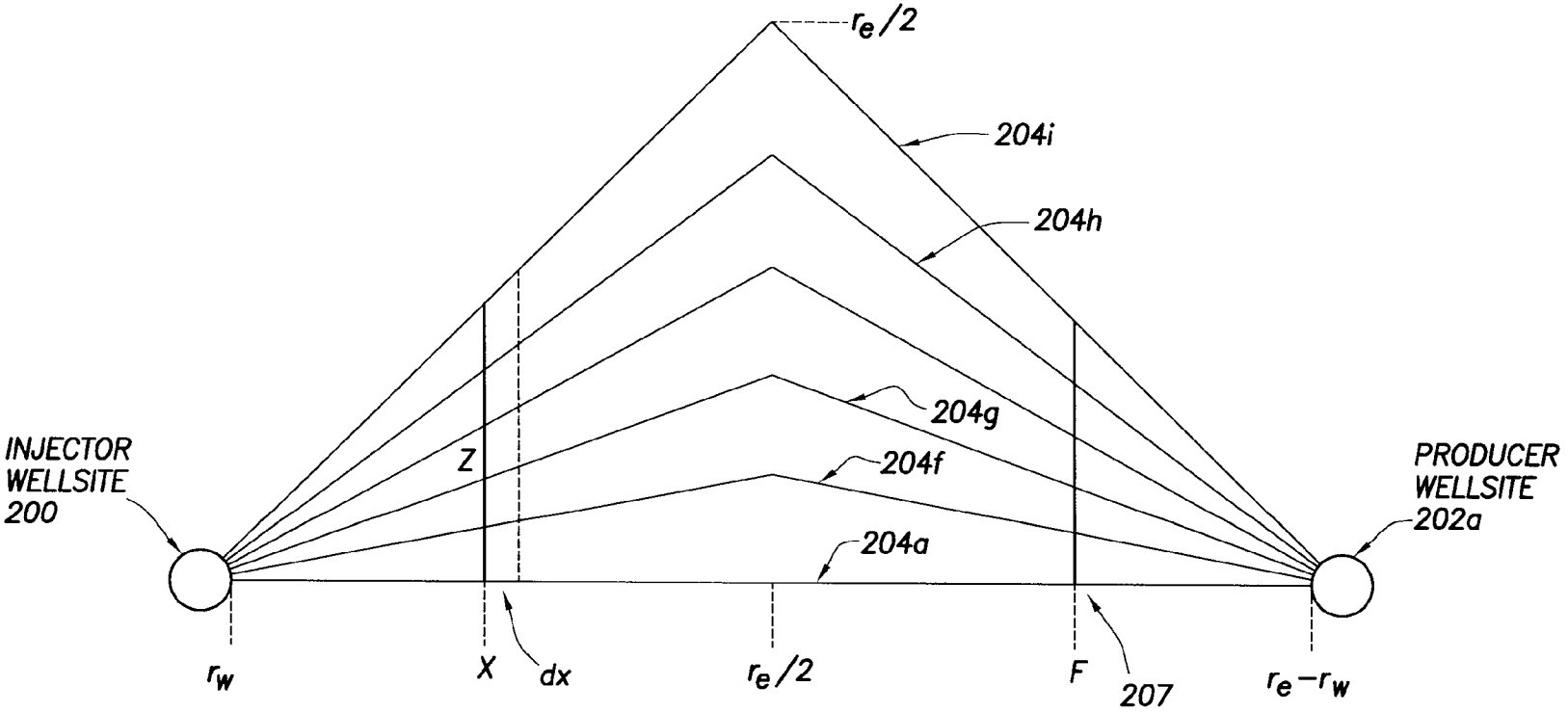
FIG. 3B shows a two dimensional triangular approximation of fluid flow of an injector-producer pair in accordance with one or more embodiments of the invention.

Referring to FIG. 3B, in one embodiment of the invention, multiple streamlines (204*a*)-(204*i*) are considered between the injector wellsite (200) and the producer wellsite (202*a*). The two dimensional (2D) triangular form shown in FIG. 3B approximates a portion of the radial fluid flow pattern from the injector wellsite (200) to the producer wellsite (202*a*) in a two dimensional formation layer with cross section in the direction perpendicular to the triangular form. By considering two fluid flows (i.e., water flow to the injector side of the flood front F and oil flow to the producer side of the flood front F in the triangular flow), IPI between these wellsites (200) and (202*a*) may be calculated from Equation 2 or Equation 3 (depending on the fluid front position) described below. Generally speaking, Equations 2 and 3 below, or the 3D model below, may be used to determine the value of any variable (such as F or Q) if the other values are known. In one embodiment of the invention, Equations 2 and 3 assume uniform displacement in the x direction along all streamlines.

In one or more embodiments, the 2D model described above may be extended to consider fractional flow by tracking the actual fluid front in each streamline and determining (i) the water saturation at each point behind the fluid front and (ii) the pressure drop of each fluid based on the relative permeability curve. In one or more embodiments, this model is equivalent to a streamline simulation. Further, in one embodiment of the invention, a three dimensional (3D) model may be constructed by multiple 2D models overlaying each other each contributing a portion of the total fluid flow.

Nomenclature in the following discussions is listed in TABLE 1 below. The use of consistent units is assumed and, accordingly, no units or conversion factors are provided.

TABLE 1

| Nomenclature | |
|---|---|
| M = | Mobility ratio |
| $S_{ro}$ = | Residual oil saturation |
| F = | Distance of water front from injector |
| h = | Net formation height |
| k = | Absolute permeability |
| $k_r$ = | Relative permeability (end point) |
| Q = | Flow rate |
| $r_w$ = | Well bore radius |
| $r_e$ = | Distance from injector to producer |
| S | Skin |
| ΔP = | Bottom-hole pressure difference from injector to producer |
| μ = | Viscosity |
| $P_{re}$ = | Reservoir pressure |

Note:
subscripts "o", "w", "i", and "p" refer to oil, water, injector, and producer, respectively.

Returning to FIG. 3B, the aforementioned triangular approximation represents one eighth of the total symmetrical fluid flow from the injector wellsite (200) to all five producers (202*a*)-(202*b*) in FIG. 3A. At distance x from the injector wellsite (200) in the direction of the producer wellsite (202*a*), the cross-sectional area of fluid flow through the two dimensional formation layer with height h may be approximated as 8 zh, where x<re/2, z=x and for x>re/2, z=$r_e$−x. Based on the aforementioned approximation and applying Darcy's linear flow for a single fluid and integrating the flow from the injector wellsite (200) to the producer wellsite (202*a*) in the right angle triangular area shown in 3B, ΔP may be determined.

If F≦$r_e$/2 (fluid interface or flood front F in the left part of the triangular), then ΔP is determined using Equation 2 as follows:

$$\Delta P = \frac{Q}{8hk}\left[\begin{array}{c}\frac{\mu}{k_{rw}}\left\{\int_{r_{wi}}^{F}\frac{1}{x}\,dx + S_i\right\} + \\ \frac{\mu_o}{k_{ro}}\left\{\int_{F}^{r_e/2}\frac{1}{x}\,dx + \int_{r_e/2}^{r_e-r_{wp}}\frac{1}{r_e-x}\,dx + S_p\right\}\end{array}\right]$$
$$= \frac{Q}{8hk}\left[\frac{\mu_w}{k_{rw}}\left\{\ln\left(\frac{F}{r_{wi}}\right) + S_i\right\} + \frac{\mu_o}{k_{ro}}\left\{\ln\left(\frac{r_e/2}{F}\right) - \ln\left(\frac{r_{wp}}{r_e/2}\right) + S_p\right\}\right]$$

If F>$r_e$/2 (fluid interface in the right part of the system), then ΔP is determined using Equation 3 as follows:

$$\Delta P = \frac{Q}{8hk}\left[\begin{array}{c}\frac{\mu_w}{k_{rw}}\left\{\int_{r_{wi}}^{r_e/2}\frac{1}{x}\,dx + \int_{r_e/2}^{F}\frac{1}{r_e-x}\,dx + S_i\right\} + \\ \frac{\mu_o}{k_{ro}}\left\{+\int_{F}^{r_e-r_{wp}}\frac{1}{r_e-x}\,dx + S_p\right\}\end{array}\right]$$
$$= \frac{Q}{8hk}\left[\begin{array}{c}\frac{\mu_w}{k_{rw}}\left\{\ln\left(\frac{r_e/2}{r_{wi}}\right) - \ln\left(\frac{r_e-F}{r_e/2}\right) + S_i\right\} + \\ \frac{\mu_o}{k_{ro}}\left\{-\ln\left(\frac{r_{wp}}{r_e-F}\right) + S_p\right\}\end{array}\right]$$

$$IPI = \frac{Q}{\Delta P}$$

Those skilled in the art will appreciate that $$\int_a^b \frac{1}{r_e - x}\,dx$$

may be evaluated by substituting y=re−x, such that dy=−dx and the aforementioned integral becomes $$-\int_{r_e-a}^{r_e-b}\frac{1}{y}\,dy = -\ln\left(\frac{r_e-b}{r_e-a}\right)$$

Further, those skilled in the art will appreciate that in order to avoid a negative pressure drop at the producer in the case of negative skin (fracturing), $$-\ln\left(\frac{r_{wp}}{r_e-F}\right) + S_p \geq 0$$

resulting in F≦$r_e$−$r_{wp}$/exp($S_p$). Using the aforementioned expression provides an upper limit for the value for F in Equation 3.

In one embodiment of the invention, the IPI values may be simulated using Equations 2 and 3 or a 3D model described above. In addition to the values required to calculate ΔP in Equations 2 and 3, an estimate of the location of the fluid front (F) is required. In one embodiment of the invention, F may be calculated using the cumulative volume of water (or other fluid(s)) injected (V) and an estimate of the geometry (e.g., height, width, length, porosity) of the flow path between the injector wellsite and the producer wellsite. Those skilled in the art will appreciate that other equations and/or techniques may be used to determine ΔP (i.e., $P_i$−$P_{wf}$) and $Q_t$.

As described above, in one embodiment of the invention, IPI calculations may be extended to cover fractional flows. In such cases, Equations 2 and 3 (and/or any other equations used) may be modified to take into account fractional flows using well known techniques such as the ones described in "The Practice of Reservoir Engineering" by L. P. Dake and/or "Fundamentals of Reservoir Engineering" by L. P. Dake. In particular, the aforementioned equations may be modified to take into account oil/water relative permeability curves, initial water saturation ($S_{wi}$) and residual oil saturation ($S_{or}$). The aforementioned modifications assume that water is the fluid being injected into the injection wellsite; however, other fluids may also be injected into the wellsite. The resulting equations may then be solved, for example, numerically to determine the corresponding IPI value(s).

In addition, while Equations 2 and 3 describe a 2D model (i.e., assumes a single layer homogeneous formation between the injector wellsite and the producer wellsite), the invention may be extended to a 3D model, which takes into account the different layers between a given injector-producer wellsite pair. In such a scenario, an IPI value may be calculated for each layer, where each layer includes, for example, a different permeability. The 3-dimensional model may also be extended to address fractional flow in one or more of the layers.

Once the IPI value for each injector-producer wellsite pair is determined, the IPI values for all injector-producer wellsite pairs with a common injector wellsite may be compared. If the distribution of the aforementioned IPI values is outside a threshold value (discussed below), then the reservoir is likely to exhibit poor areal sweep. In particular, if the aforementioned IPI values have a large distribution (which may be determined, for example, on a per-oilfield basis), then it is likely that a disproportionately larger volume of the injected fluids may flow between the injector-producer wellsite pairs that have the higher IPI values. Conversely, a disproportionately smaller volume of the injected fluids may flow between the injector-producer wellsite pairs that have the lower IPI values. The net result of the above is poor sweep over the injector-producer wellsite pairs being analyzed. Said another way, trapped hydrocarbons between the injector-producer wellsite pairs that have the lower IPI values may not be swept as efficiently (or at all). Those skilled in the art will appreciate that the terms "larger", "small", "higher", and "lower" are not absolute values; rather they are relative the IPI values being considered.

In one embodiment of the invention, if the IPI values are being simulated for a given wellsite pattern (e.g., a five spot pattern), the calculated IPI values may provide an indication of how fluid is anticipated to flow between the various injector-producer wellsite pairs in the wellsite pattern. This information may then be used to adjust the wellsite pattern in order to increase vertical and/or areal sweep.

In one embodiment of the invention, the threshold value may be determined on a per-oil field basis, on a per-reservoir basis, or at any other level of granularity. In one embodiment of the invention, the distribution is large if the IPI values being considered are not substantially similar.

Figure 4:
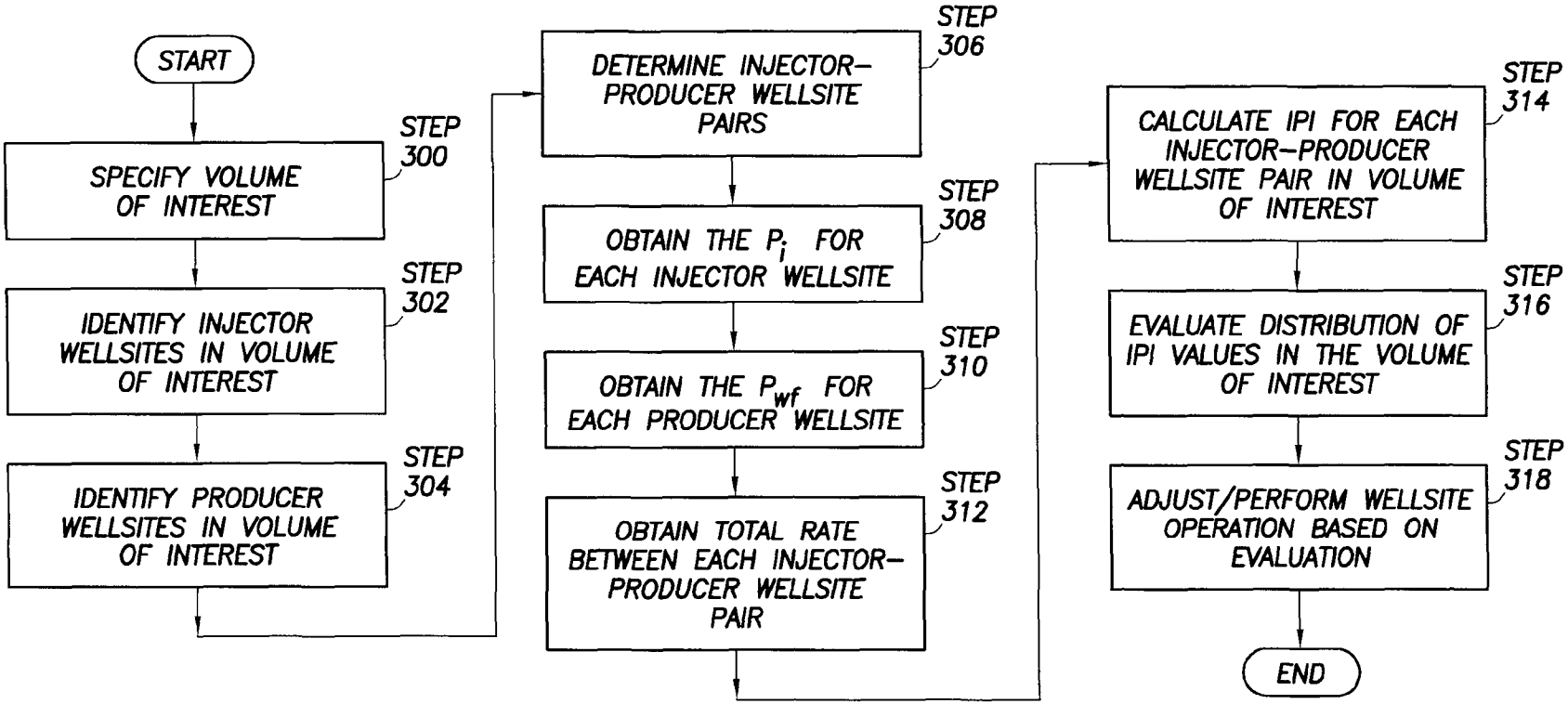
FIG. 4 shows a flowchart in accordance with one or more embodiments of the invention.

FIG. 4 shows a method in accordance with one embodiment of the invention. More specifically, FIG. 4 shows a method for analyzing the behavior of a number of wells in an oilfield (or portion thereof) using IPI and then adjusting the wellsite operations based on the IPI values. While the various steps in the flowchart are presented and described sequentially, one of ordinary skill will appreciate that some or all of the steps may be executed in different orders and some or all of the steps may be executed in parallel.

In Step 300, a volume of interest is specified. In one embodiment of the invention, the volume of interest corresponds to an area within a reservoir in an oilfield in which fluid injection is used (or to be used) to produce (or increase production of) hydrocarbons (e.g., oil). In Step 302, injector wellsites in the volume of interest are identified. If the injector wellsites are proposed (i.e., have not yet been drilled), then the injector wellsites identified in Step 302 correspond to wellsites which are intended to be located in the volume of interest.

In Step 304, producer wellsites in the volume of interest are identified. If the producer wellsites are proposed (i.e., have not yet been drilled), then the producer wellsites identified in Step 304 correspond to wellsites which are intended to be located in the volume of interest.

In Step 306, injector-producer wellsite pairs are determined. In one embodiment of the invention, each injector-producer wellsite pair includes one injector wellsite and one producer wellsite. Further, the injected fluid flows from the injector wellsite to the producer wellsite. In one embodiment of the invention, if the injector wellsite and producer wellsite are existing wellsites, then well known techniques may be used to determine whether fluid is flowing from a given injector wellsite to a particular producer wellsite. Alternatively, if the injector wellsite and producer wellsite are proposed wellsites, then a simulator used to determine IPI may be setup to initially assume that the injected fluid flows from a given injector wellsite to a particular producer wellsite. This assumption may be modified based on the availability of additional information. In another embodiment of the invention, the volume of interest may be simulated to determine (at least based on a simulation model) whether the injected fluid flows from a given injector wellsite to a particular producer wellsite.

Continuing with the discussion of FIG. 4, in Step 308, $P_i$ for each injector wellsite is determined. In Step 310, $P_{wf}$ for each producer wellsite is determined. $P_i$ may be determined using data obtained from the injector wellsite (or any other relevant data source) and/or determined using a simulation tool. $P_{wf}$ may be determined using data obtained from the producer wellsite (or any other relevant data source) and/or determined using a simulation tool. Those skilled in the art will appreciate that Steps 308 and 310 may be replaced with a single determination of $\Delta P$ obtained using, for example, Equations 2 and 3.

In Step 312, the total flow rate between each injector-producer wellsite pair is determined. In one embodiment of the invention, total flow rate ($Q_t$) is determined and/or simulated using well known techniques in the art. In one embodiment of the invention, the total flowrate may be determined on a per-layer basis if multiple layers exist between the injector wellsite and the producer wellsite. In one embodiment of the invention, if there are multiple injectors for a single producer and/or multiple producers for a single injector, then a determination made be made about what proportion of the total flow into an injector reaches a given producer. As discussed above, there are multiple methods for determining the flow rate between a given injector-producer pair. In one embodiment of the invention, if the formation between the injector and producer is layered, then production logs may be used to determine the flow rate between the injector-producer pair.

In Step 314, the IPI for each injector-producer wellsite pair is calculated using the values obtained in Step 308, Step 310, and Step 312 using the equations described above. In Step 316, the IPI values for the volume of interest are evaluated. Evaluating the IPI values may include, but is not limited to,:

(i) reviewing the IPI values for all injector-producer wellsite pairs that have common injector wellsite to determine whether the IPI values are substantially similar or within a threshold range;

(ii) reviewing the IPI values for all injector-producer wellsite pairs that have common producer wellsite to determine whether the IPI values are substantially similar or within a threshold range; and/or (iii) reviewing the IPI values for all (or a subset of the) injector-producer wellsite pairs in the volume of interest to gain an understanding of the vertical and/or areal sweep of the volume of interest.

In Step 318, the results of the evaluation are used to adjust/perform a wellsite operation. For example, the evaluation results may be used to adjust an injection rate of an injection wellsite and/or a production rate of a producer wellsite. Further, the evaluation results may be used to determine which wellsite pattern to select and subsequently implement in the volume of interest.

In one embodiment of the invention, the method described in FIG. 4 may be used to determine where to drill a new injector and/or producer wellsite in an existing oilfield. In another embodiment of the invention, the method described in FIG. 4 may be used to select a wellsite pattern (from a number of possible wellsite patterns) with the highest anticipated vertical and/or areal sweep efficiency. In this scenario, various wellsite patterns may be simulated using the method shown in FIG. 4 and the most appropriate wellsite pattern for the desired outcome (e.g., maximize vertical sweep, maximize areal sweep, etc.). The IPI values from the simulations are used to evaluate the vertical and/or areal sweep of a volume of interest.

In one embodiment of the invention, the IPI value(s) for a given injector-producer wellsite pair(s) may initially be calculated (e.g., using a simulator) and subsequently analyzed to determine a course of action (e.g., adjust and/or perform a wellsite operation). The IPI value(s) may then be re-calculated at a later time using data obtained from the field. The calculated IPI value(s) may then be compared to the measured IPI value(s). If the calculated IPI value(s) are different from the measured IPI value(s), then measured IPI value(s) may be evaluated and new course of action may be determined or the existing course of action (determined using the initial IPI value(s)) may be modified. In addition, the difference between the calculated IPI value(s) and the measured IPI value(s) may indicate that the assumptions/understanding of the reservoir used to determine the calculated IPI value(s) is incorrect. In such cases, the difference between the calculated IPI value(s) and the measured IPI value(s) may trigger further analysis of the reservoir in order to understand why there is a difference between the calculated IPI value(s) and the measured IPI value(s). In one example, the difference between the calculated IPI value(s) and the measured IPI value(s) may be due to damage in reservoir.

In one embodiment of the invention, the IPI value for a given injector-producer wellsite pair may be calculated using real-time data at various time intervals. The real-time IPI values may be used to predict when water breakthrough may occur. In one embodiment of the invention, real-time data corresponds to data obtained from the field during a continuous monitoring operation(s) at the wellsite(s). As an alternative, field data, which is not necessarily real-time data, may be used for the above calculation. In one embodiment of the invention, field data is data obtained at the wellsite(s). Based on this prediction, some action may be taken to avoid and/or mitigate the problems (e.g., water production, sand production, etc.) associated with water breakthrough.

As described with respect to FIG. 3A above, as the flood front (207) approaches the producer wellsite (202*a*), pressure gradient increases. This may contribute to single-grain or tensile failure causing sand production when, and even before, water breakthrough occurs. As shown in FIG. 3B. The longest streamline (204*i*) is √2 times the length of the straight streamline (204*a*). Because the streamlines (204*a*)-(204*i*) all have the same pressure difference, the pressure drop gradient, and therefore fluid velocity, in the longer streamline (204*i*) is √2 times less than that in the straight streamline (204*a*). This gives a transit time in the longer streamline (204*i*) of twice that in the shorter streamline (204*a*). Thus, the breakthrough time is proportional to the square of the streamline length. For example, if water breakthrough occurs after one year in the shorter stream line (204*a*), it will take two years to sweep the longer streamline (204*i*). In one embodiment of the invention, modelling flooding operation based on IPI may be used for designing and balancing wellsite patterns to minimize the variation in streamline lengths.

Those skilled in the art will appreciate that the aforementioned square root relationship is only true for a mobility ratio of 1. With an adverse mobility ratio, the flood front F (207) in the shorter streamline (204*a*) may accelerate as the flood front (207) advances and length of low mobility oil remaining (205*b*) decreases. This causes the breakthrough time to be higher than the square root relationship. This may result in long streamlines not being swept in the lifetime of a field leaving pockets of un-swept oil. In one embodiment of the invention, modelling flooding operation based on IPI may be used for designing and balancing wellsite patterns to minimize the variation in streamline lengths, particularly in oilfields with adverse mobility.

Those skilled in the art will appreciate that while FIG. 4 describes a "volume of interest," the method may be modified to evaluate an "area of interest."

FIG. 5A-5K show examples of simulation results of flooding operation based on the five spot model described above with a mobility ratio of 10. The following examples are not intended to limit the scope of the invention.

Figure 5A:
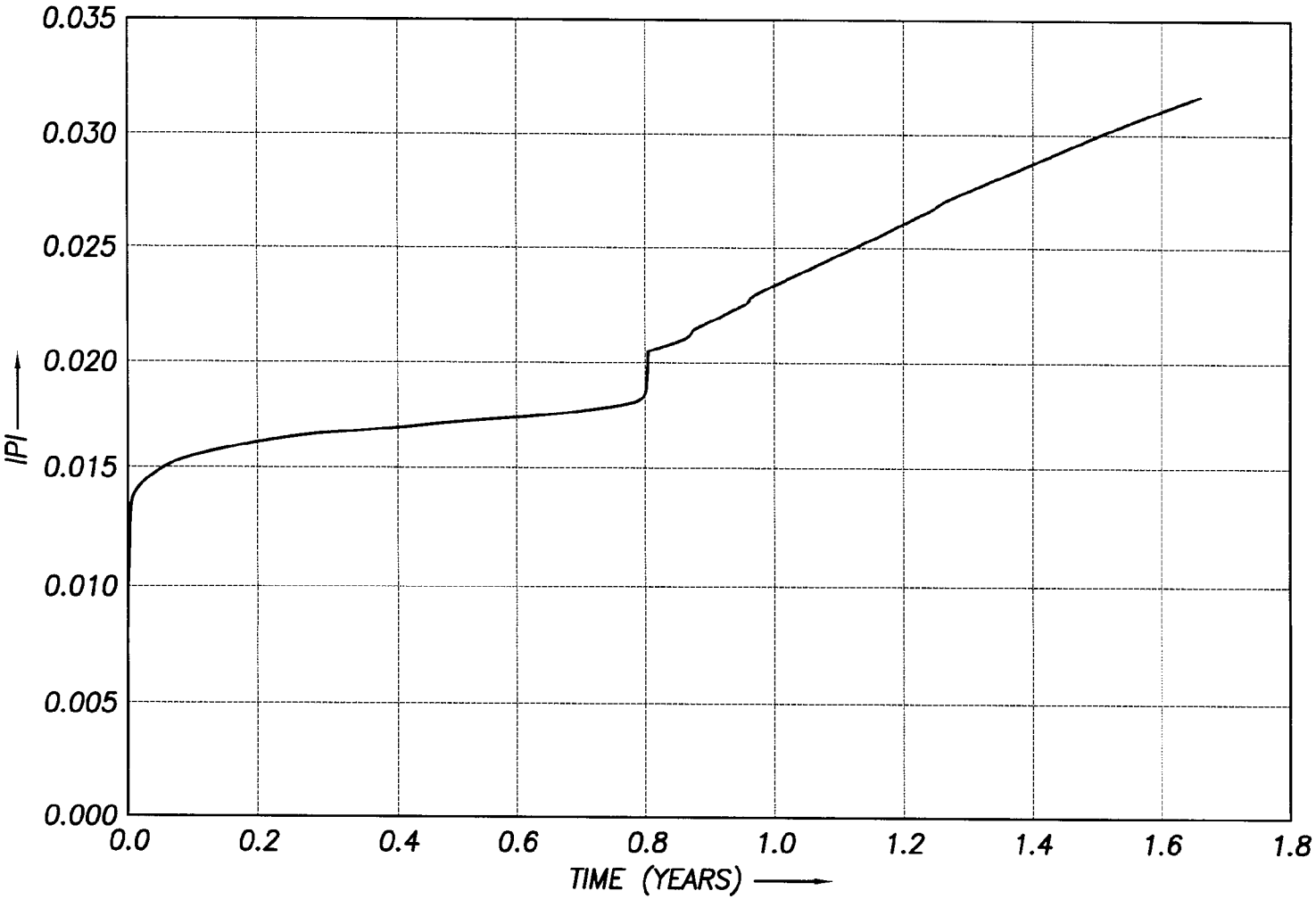
FIG. 5A-5K show examples of modeling waterflooding operations of an oilfield in accordance with one or more embodiments of the invention.

FIG. 5A shows the IPI versus time for an exemplary flooding operation. As shown in FIG. 5A, there is a rapid increase in IPI (and liquid rate) initially as the higher viscosity oil is displaced from the injector. This is followed by a slowly increasing IPI and then rapid rise just before water breakthrough at the 1 year mark. After breakthrough the IPI gradually increases as the remaining water saturation gradually increases and breakthrough occurs in the longer streamlines (e.g., (204*i*) of FIG. 3B) in the triangular form of the approximated fluid flow pattern.

Figure 5B:
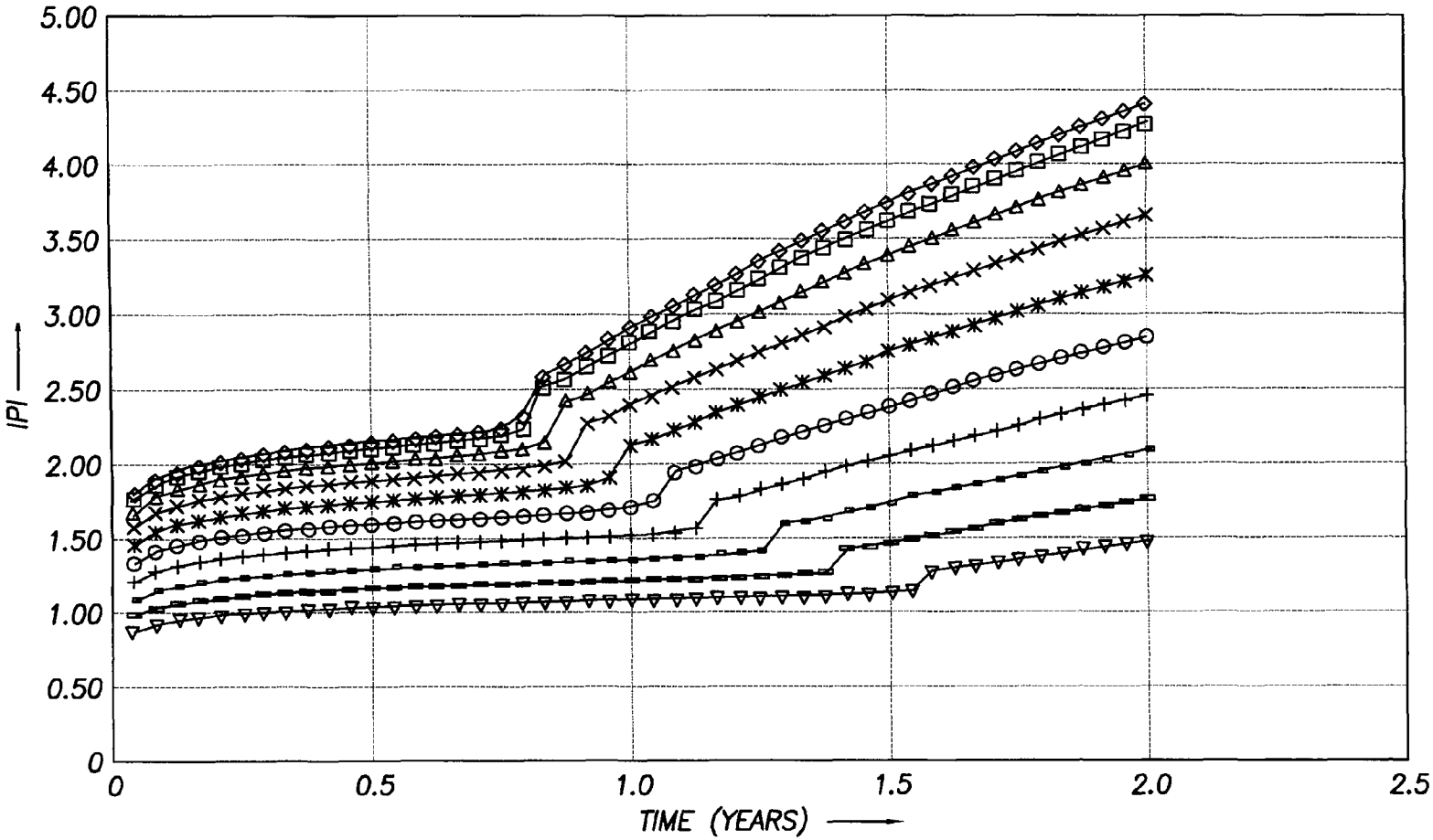

FIG. 5B shows the flow rate in each of the streamlines (e.g., (204*a*)-(204*i*) of FIG. 3B) which make up the triangular form of the approximated fluid flow pattern. As shown in FIG. 5B, the breakthrough time varies from 0.8 years in the shortest streamline to 1.6 years in the longest streamline as indicated by the rapid increase in IPI corresponding to each of the streamlines.

Figure 5C:
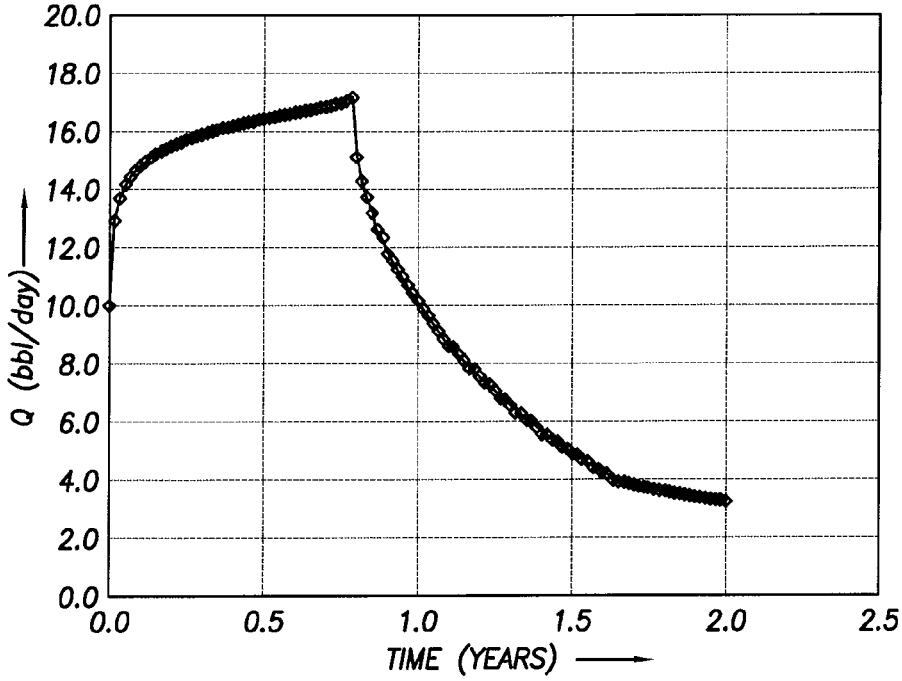

FIG. 5C shows the oil rate versus time with the expected decline after water breakthrough.

Figure 5D:
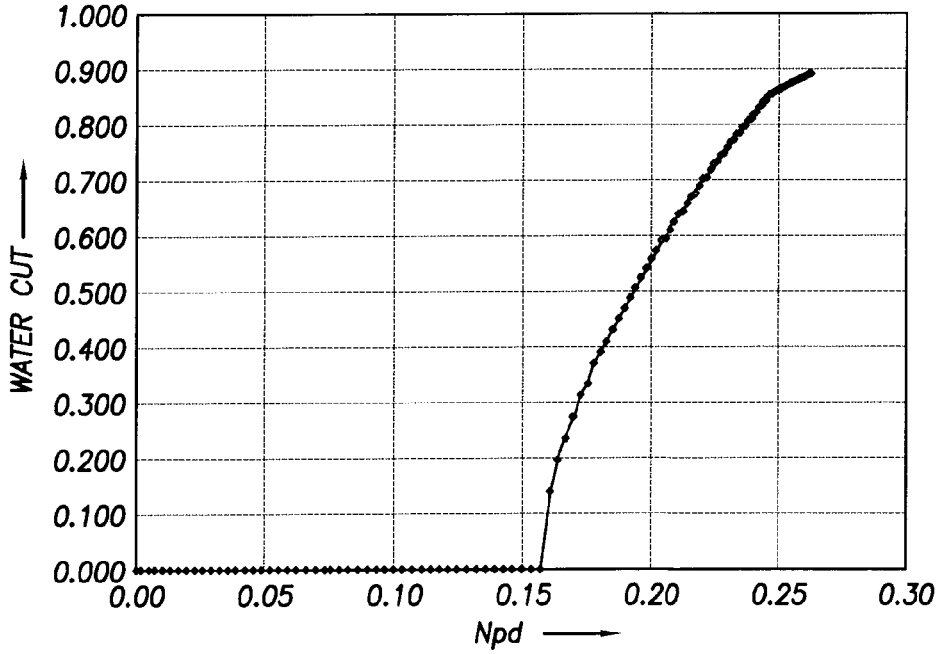

FIG. 5D shows the water-cut versus recovery factor ($N_{pd}$). This is a useful plot to compare to historical field data to calibrate the model. As shown in FIG. 5D, the water cut increases less rapidly after $N_{pd}$=0.25, which corresponds to the time of breakthrough of the longest streamline. Further, FIG. 5D shows that the overall water-cut will reach an uneconomic level before all of the oil has been swept from the longest streamline contributing to a relatively low recovery factor.

FIGS. 5A-5D described above show results in a single formation layer using the 2D model. As discussed above, the 2D modelling may be extended to a multi-layer system using a 3D model, where the multiple formation layers are not in vertical communication (i.e., no flowlines crossing any formation layer boundaries). One such model is used for simulating three formation layers having permeabilities of 200 mD (layer 1), 100 mD (layer 2), and 50 mD (layer 3), respectively. Again the mobility ratio is 10 and the end point $K_{rw}$=0.25.

Figure 5E:
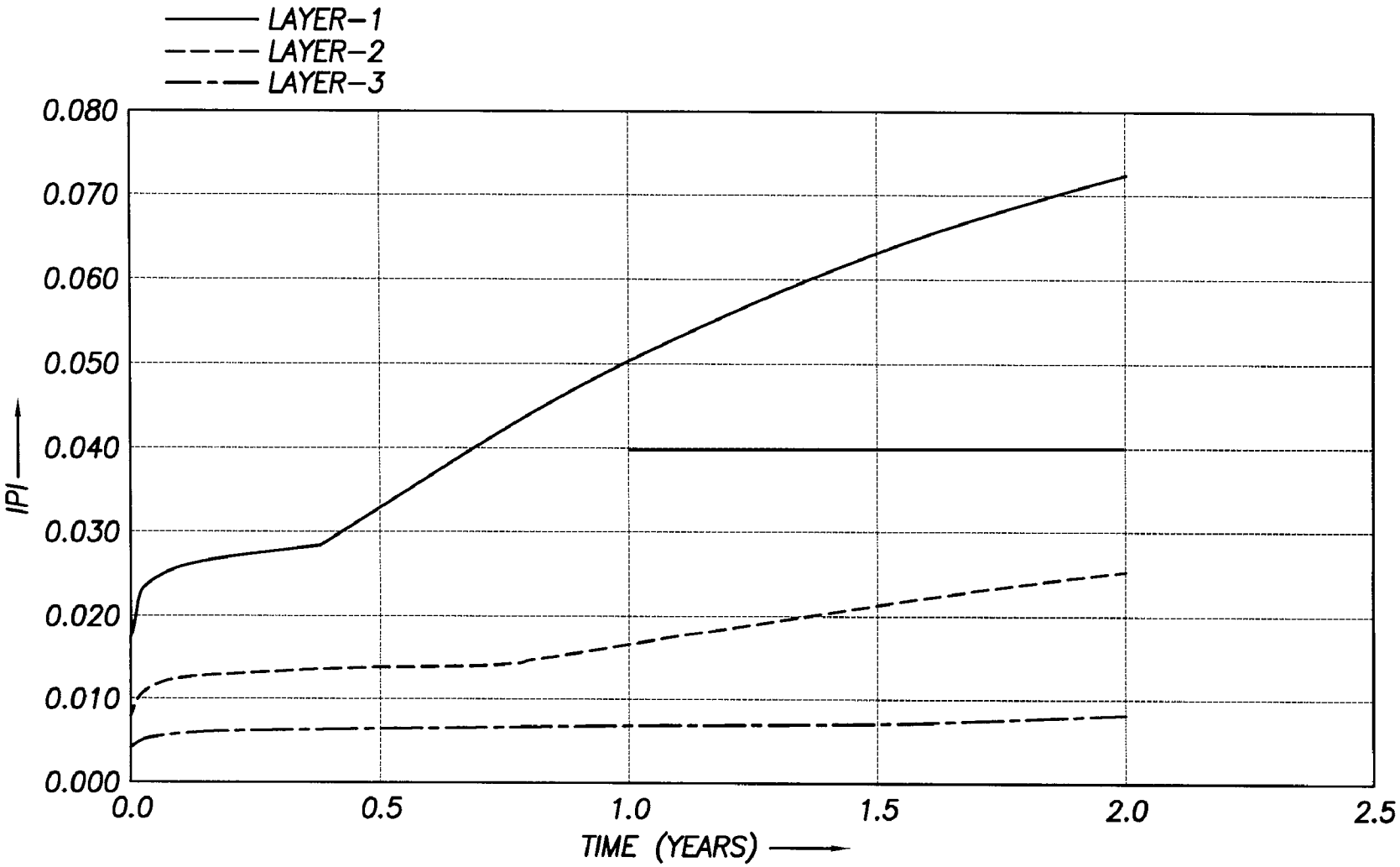

Referring to FIG. 5E, FIG. 5E shows the IPI of each of the three formation layers versus time. It is shown that the breakthrough times of 0.4, 0.8 and 1.6 years are in proportion to the formation layer permeabilities. At earlier portions of the time period, IPIs (and liquid rates) of the layers are in proportion to the permeabilities. However, at later portion of the time period, this changes. For example, at the 2 years mark, the ratio of IPIs between the formation layer with 50 mD and the formation layer with 200 mD is 10 to 1 despite a permeability ratio of only 4 to 1. This relatively low IPI (and hence injection and production) in the formation layer with 50 mD results in poor vertical sweep as most of the fluid flow is through the higher permeability layer (and at later time this is mainly injected water). This effect is due to the poor mobility ratio.

Figure 5F:
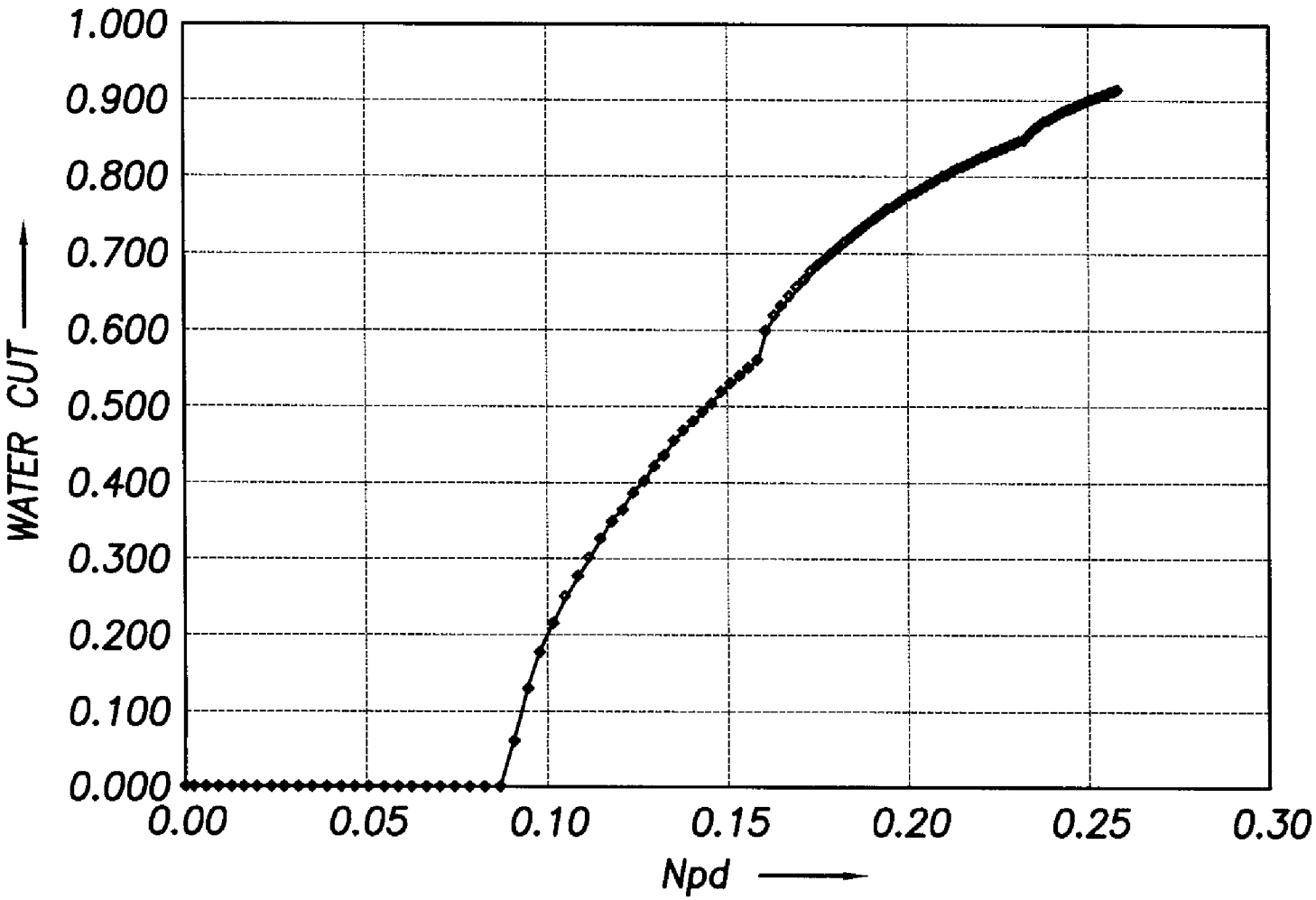

FIG. 5F shows the water-cut versus recovery factor. The effect of each water breakthrough can be seen where the curve exhibits discontinuity in the slope at approximately Npd equals 0.16 and 0.23 along the X-axis. This effect has often been observed in historical production.

The calculated IPI of the examples above is for a pair of wells. In one embodiment of the invention, IPIs from all producer wells associated with an injection well may be summed to determine the behaviour of an injector with multiple associated producers. A similar technique may be applied to a producer with multiple associated injectors. In one embodiment, weighted values may be used if the IPIs are very different.

In one embodiment of the invention, a modified Hall plot maybe used to show the IPIs from single injector and multiple producers. In such cases, the modified Hall coefficient may be calculated by integrating the bottomhole injection pressure minus the bottomhole flowing pressure of associated producers. In this manner the slope of the plot is the reciprocal of the IPI.

Figure 5G:
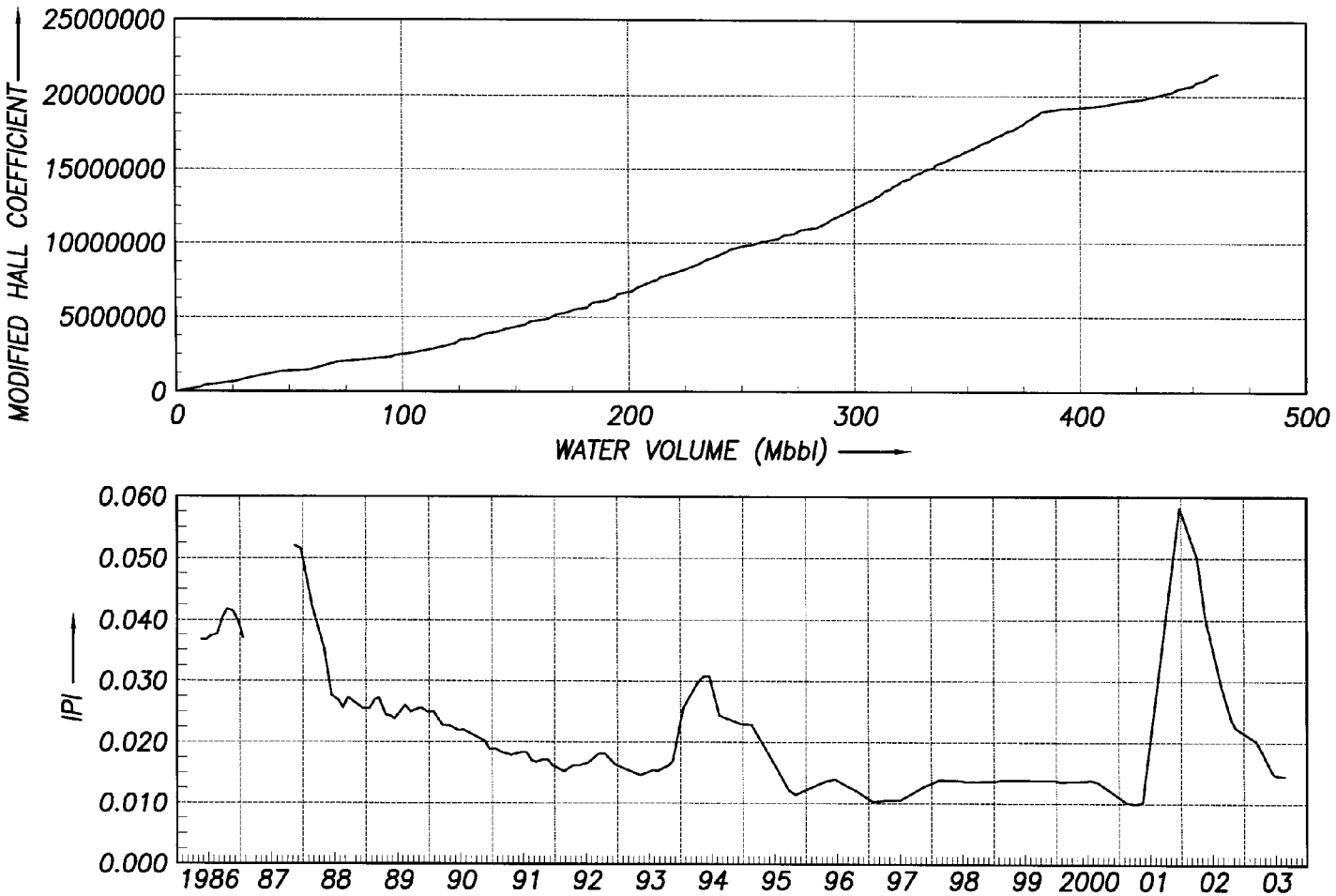

Referring to FIG. 5G, FIG. 5G shows an example of a modified Hall plot along with a plot of the IPI derived from the Hall plot. As shown in FIG. 5G, the IPI increases abruptly in year 2001, which may be attributed to water breakthrough at the producer. Further, the periods of declining IPI following the water breakthrough may be due to damage buildup in the injector.

In one embodiment of the invention, when using Equations 2 and 3 or other IPI models (such as the 3D model with fractional flow), the injector skin is multiplied by the (low) water viscosity and the producer skin is multiplied by the (high) oil viscosity. The aforementioned adjustments may be made to Equations 2 and 3 to take into account that the producer skin is significant to the IPI and may severely affect the injector behaviour. In one embodiment of the invention, the effect on associated injectors may be modelled using IPI when designing field operations on producers that impose a skin value (e.g., with a gravel pack completion) or reduced skin (e.g., with perforating, acidizing or fracturing).

Maintaining balanced wellsite patterns in fields with poor mobility ratio is often challenging when completion practices cause variations in skin values from well to well. In one embodiment of the invention, balanced wellsite patterns in fields with poor mobility ratio may be modelled using IPI.

Figure 5H:
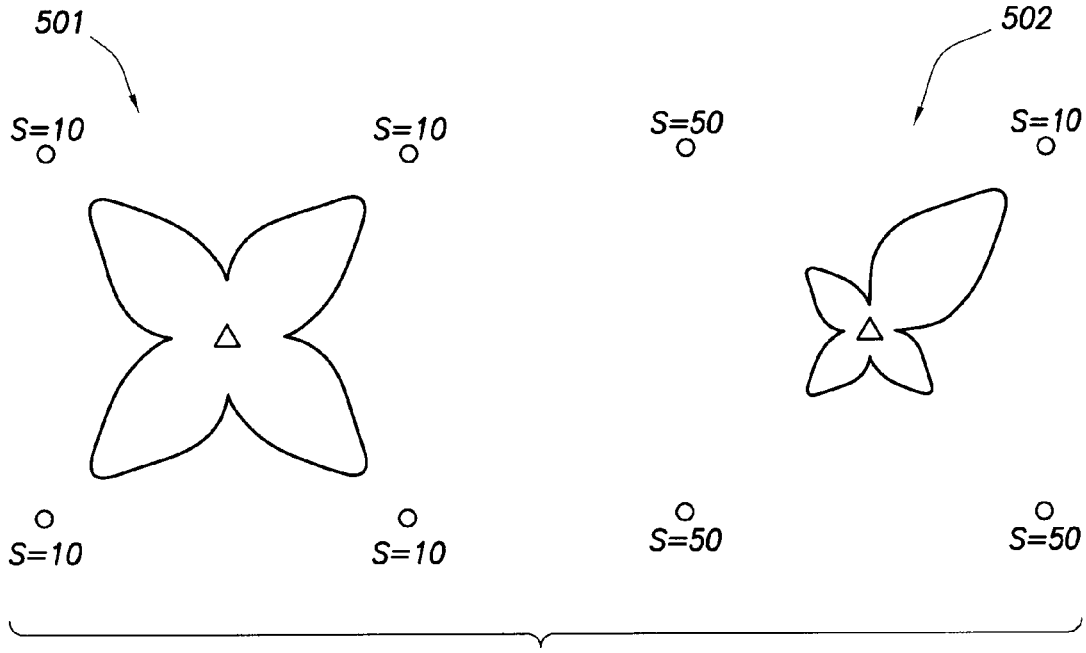

Referring to FIG. 5H, consider a complete five spot pattern with one injector and four producers all of which have a skin damage value of 10. Water is injected into the system with symmetrical areal sweep (501). However, if the skin in three of the well is increased to 50, then the areal sweep (502) significantly degrades due to the fact that three of the wells have a high skin (e.g., due to old gravel packs) and one well has a lower skin value. This poor areal sweep, despite the same $P_{wf}$ in all producers, is due to the difference in the IPI between the injector and each of the producers. In the configuration (502), once the water breaks through to the North East producer, the IPI associated with that well will gradually increase and further decrease the flow rate to the other producers. The distribution of skin damage in the producers has a major effect on the areal sweep efficiency of the wellsite pattern.

Figure 5K:
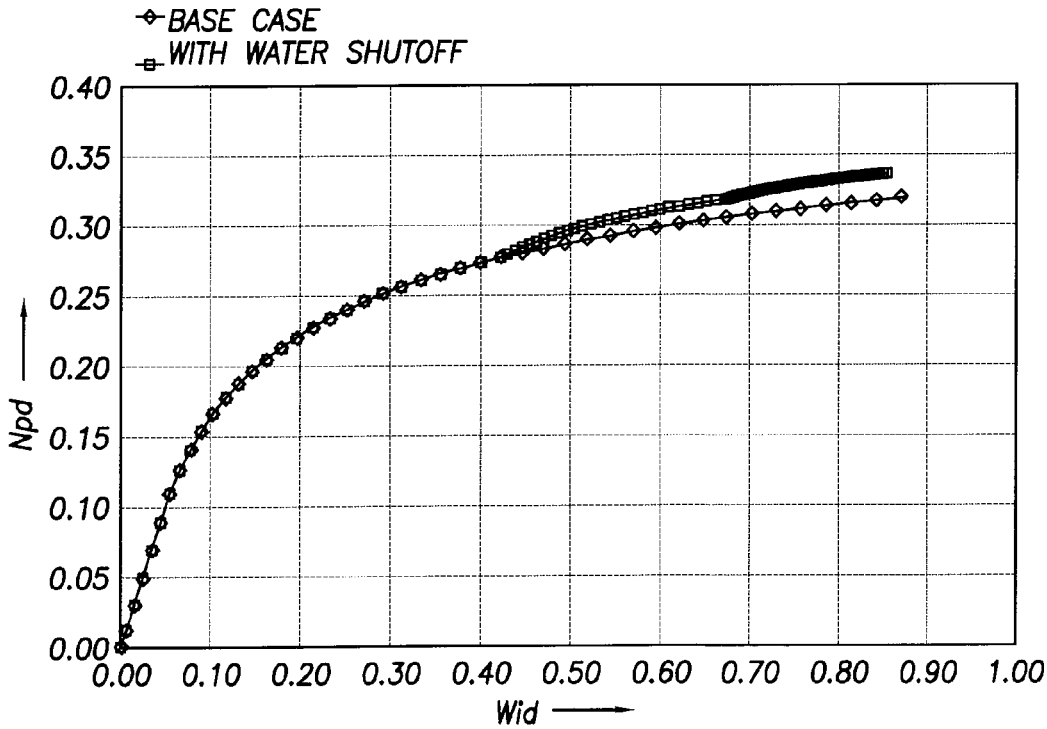
Figure 5I:
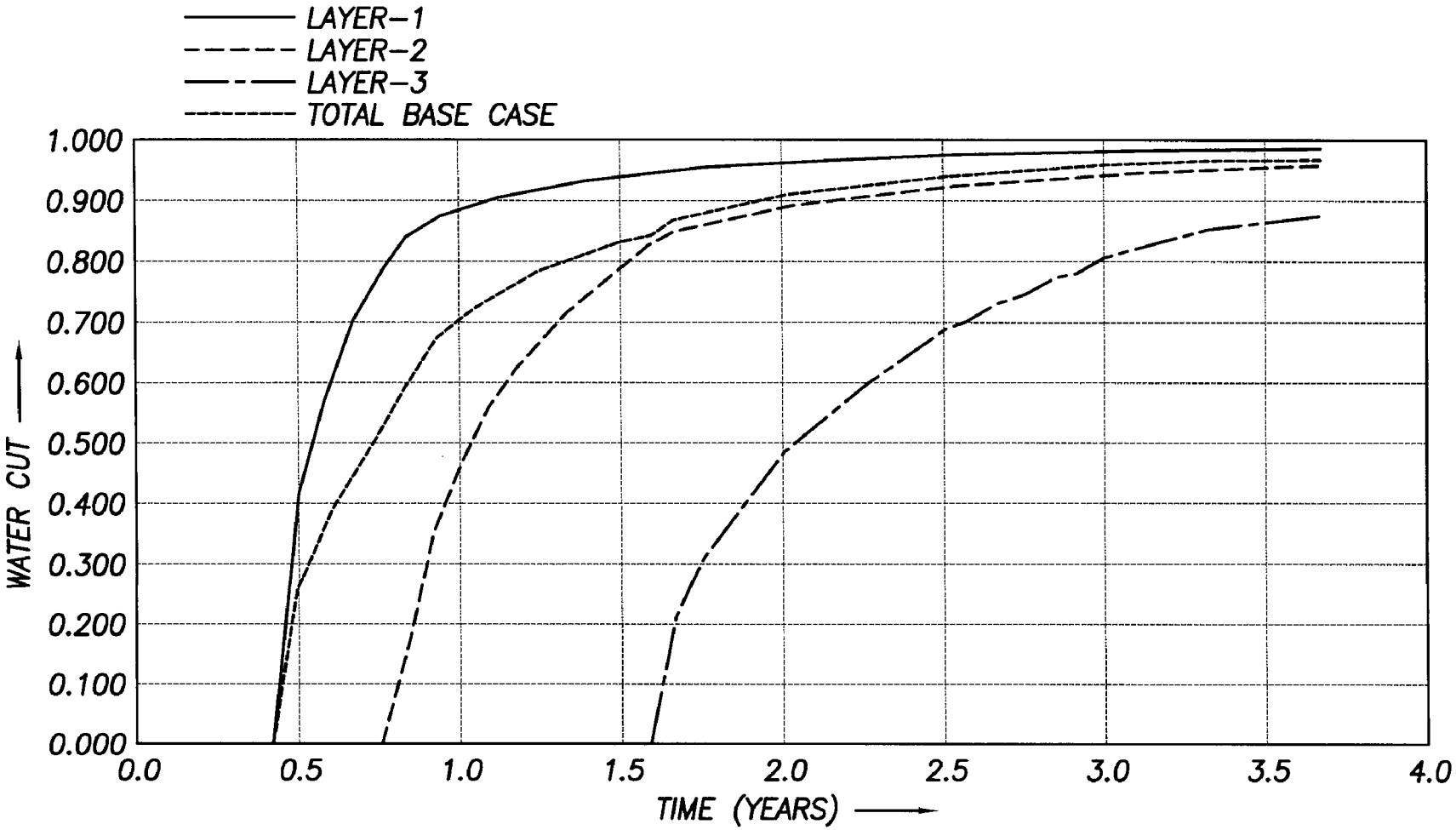

Referring to FIG. 5I, FIG. 5I shows the results of continuing to injection water in the system shown in FIG. 5E. Specifically, water is injected into the system until the economic limit of water cut of 97 percent is reached for the well. FIG. 5I depicts the water cut in each layer and the overall water cut. FIG. 5I further depicts that the water cut in layer 1 is higher than the economic limit of 97 percent for much of the pattern life (i.e., the economical life of the wellsite pattern) because of the higher IPI in that layer. A clear need exists for water shut off in this layer. One strategy is to shut off each layer when the layer reaches the water cut economic limit.

Figure 5J:
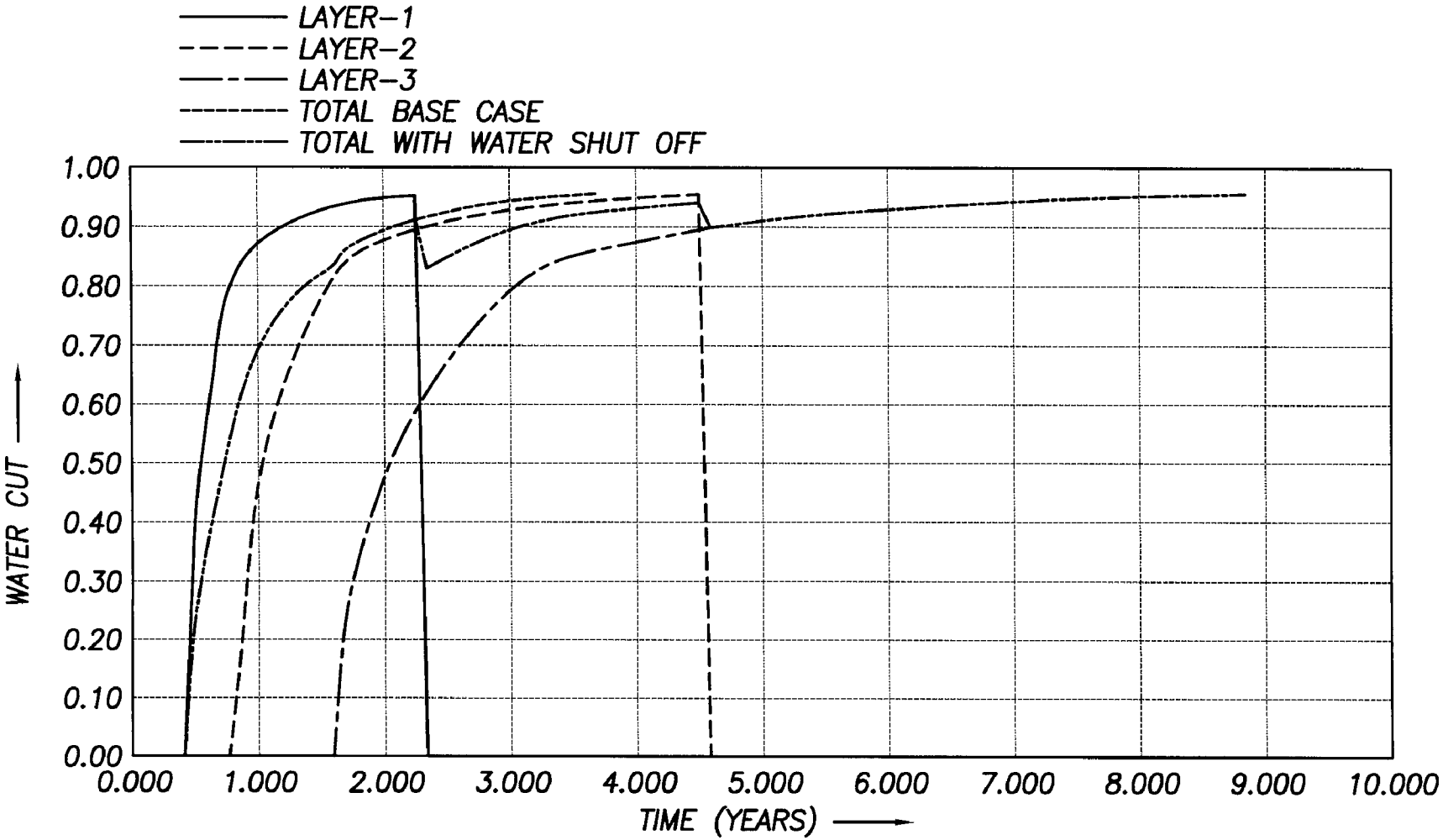

An identical model is run with a limit of 97 percent water cut in layers 1 and 2 after which they are shut off. The resulting total water cut is shown in FIG. 5J where the effect of water shut off can be seen by comparing the curve labeled "total base case" with the curve labeled "total with water shut off". Note that the pattern life is now extended to 6 years instead of 3.7 years.

FIG. 5K shows the recovery factor versus pore volumes of water injected for the base case (FIG. 5I) and the water shut-off case (FIG. 5J). Water shut-off is clearly effective to both increase the recovery factor and decrease the volume (and cost) of injected water by improving the vertical sweep efficiency.

Those skilled in the art will appreciate that in fields with a poor mobility ratio, all effects of heterogeneity are amplified. Accordingly, as water advances in a given formation layer (or direction) based on even a small heterogeneity, the IPI (and flow rate) increases in that formation layer (or direction) and the flood front becomes unstable resulting in poor areal and/or vertical sweep efficiency. This result may be observed due to the naturally occurring (or induced intentional or otherwise) heterogeneity in the formation or damage causing skins, variations in stimulation practices, variations in streamline lengths due to non-uniform pattern shapes, variations in voidage replacement ratios from one pattern to the next, etc.

In one embodiment of the invention, the effect of IPI and unstable displacement are modeled in all aspects of the field development to counteract the effects of heterogeneity amplified by poor mobility as described above. The poorer the mobility ratio, the more these effects need to be considered. In one embodiment of the invention, the effect of IPI and unstable displacement are modeled in the field development plan. For example, the wellsite pattern and new well locations may be chosen for a minimum variation in streamline length based on the IPI modeling. The IPI modelling may also consider the effect of mixing of horizontal and vertical wells in the same area of an oilfield leading to large variations in streamline length and therefore poor sweep in new well designs. As a result, completions may be required to allow control of production and injection profile through the use of inflow control devices or waterflood regulators. For example, a multi-lateral well without flow control devices in a field with a high mobility ratio typically become dominated by injection into, or production from, one single lateral with the highest IPI.

In one embodiment of the invention, the effect of IPI and unstable displacement are modeled for operation of existing wells. For example, wellsite pattern may be balanced through the selection of injection rates and production wells in fields with a high mobility ratio. Workovers, including stimulation and perforating work, may also take into account the effect of changing the IPI on the pattern In one embodiment of the invention, the effect of IPI is modeled in water management practices as poor mobility ratios amplify the effect of both natural and man-made heterogeneity. In one embodiment of the invention, the IPI is modeled to determine the effect of injection rate from high damage in associated producers. In one embodiment of the invention, the IPI is modeled to determine the presence and/or impact of sanding problems associated with water production due to effect of increasing pressure gradient at the producer. In one embodiment of the invention, the IPI is modeled to analyze severe areal sweep problems due to large variations of streamline lengths. In one embodiment of the invention, the IPI is modelled to analyze the areal sweep efficiency of the pattern due to skin damage in the producers. In one embodiment of the invention, the IPI is modeled to determine vertical sweep with respect to the variation of IPI layers. In one embodiment of the invention, the IPI is modeled to improve vertical sweep through water shut off and/or control of the injection or production profile. In one embodiment of the invention, the IPI is modelled to improve vertical sweep to improve recovery and to reduce water handling costs.

Figure 6:
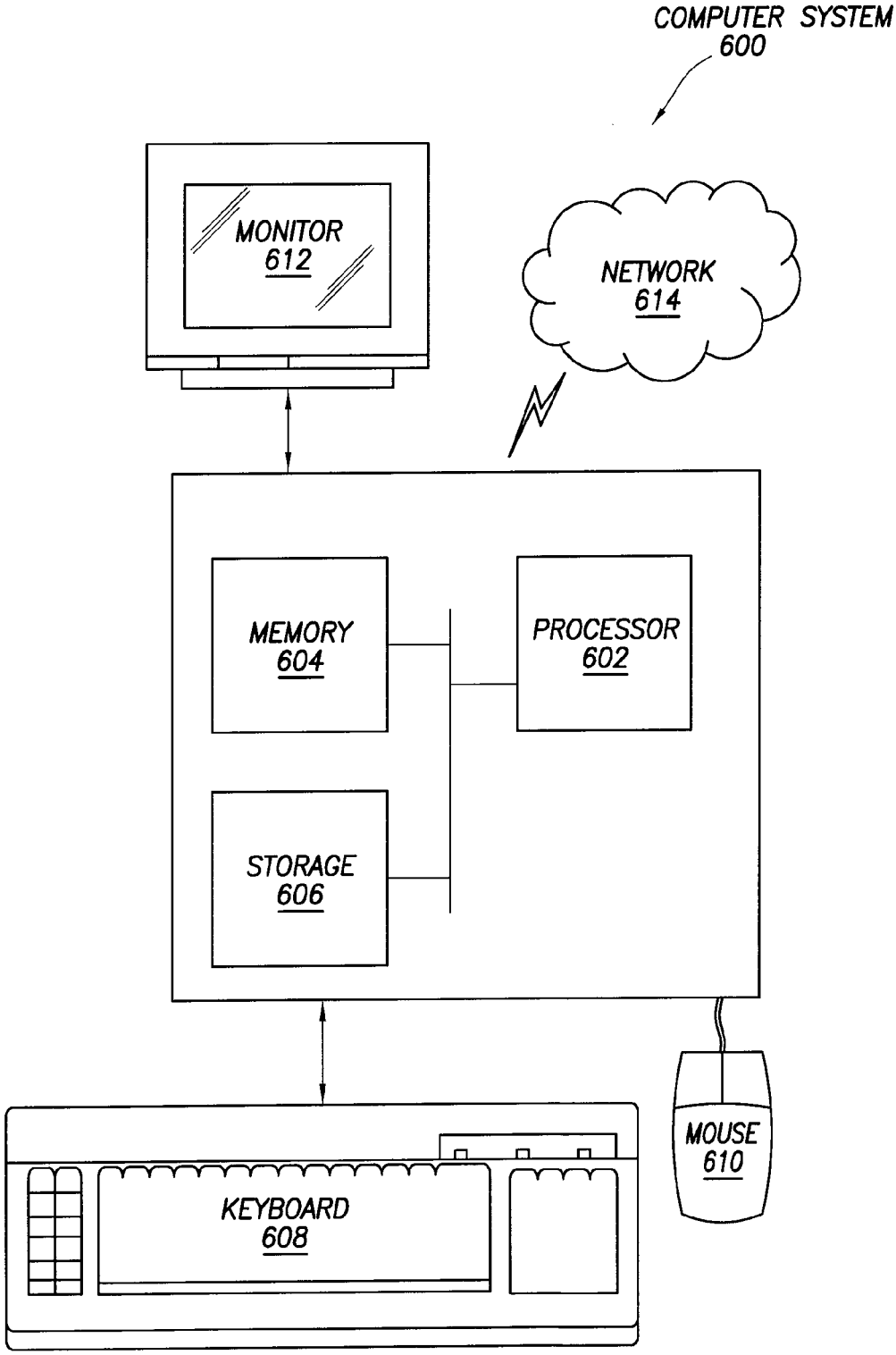
FIG. 6 shows a computer system in accordance with one or more embodiments of the invention.

Embodiments of the invention (or portions thereof) may be implemented on virtually any type of computer regardless of the platform being used. For example, as shown in FIG. 6, a computer system (600) includes one or more processor(s) (502), associated memory (604) (e.g., random access memory (RAM), cache memory, flash memory, etc.), a storage device (606) (e.g., a hard disk, an optical drive such as a compact disk drive or digital video disk (DVD) drive, a flash memory stick, etc.), and numerous other elements and functionalities typical of today's computers (not shown). The computer system (600) may also include input means, such as a keyboard (608), a mouse (610), or a microphone (not shown). Further, the computer system (600) may include output means, such as a monitor (612) (e.g., a liquid crystal display (LCD), a plasma display, or cathode ray tube (CRT) monitor). The computer system (600) may be connected to a network (not shown) (e.g., a local area network (LAN), a wide area network (WAN) such as the Internet, or any other similar type of network) with wired and/or wireless segments via a network interface connection (not shown). Those skilled in the art will appreciate that many different types of computer systems exist, and the aforementioned input and output means may take other forms. Generally speaking, the computer system (600) includes at least the minimal processing, input, and/or output means necessary to practice embodiments of the invention.

Further, those skilled in the art will appreciate that one or more elements of the aforementioned computer system (600) may be located at a remote location and connected to the other elements over a network. Further, embodiments of the invention may be implemented on a distributed system having a plurality of nodes, where each portion of the invention may be located on a different node within the distributed system. In one embodiments of the invention, the node corresponds to a computer system. Alternatively, the node may correspond to a processor with associated physical memory. The node may alternatively correspond to a processor with shared memory and/or resources. Further, software instructions for performing embodiments of the invention may be stored on a computer readable medium such as a compact disc (CD), a diskette, a tape, or any other computer readable storage device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of analyzing a subterranean formation, comprising:

specifying a volume of interest in the subterranean formation;

specifying an injector wellsite, which penetrates the volume of interest;

specifying a first producer wellsite and a second producer wellsite, each of which penetrates the volume of interest;

calculating, using a processor of a computer system, a first Injectivity-Productivity Index (IPI) for a first injector-producer wellsite pair which includes the injector wellsite and the first producer wellsite, wherein the first IPI is calculated based on a total flowrate of injected fluid between the injector wellsite and the first producer wellsite, a first bottom hole pressure of the injector wellsite, and a second bottom hole pressure of the first producer wellsite;

calculating, using the processor, a second IPI for a second injector-producer wellsite pair which includes the injector wellsite and the second producer wellsite, wherein the second IPI is calculated based on the total flowrate of injected fluid between the injector wellsite and the first producer wellsite, the first bottom hole pressure of the injector wellsite, and a third bottom hole pressure of the second producer wellsite;

determining, using the processor, whether the first IPI is substantially equal to the second IPI to obtain an analysis result; and adjusting a wellsite operation based on the analysis result.

2. The method of claim 1, wherein obtaining the analysis result comprises identifying water breakthrough based on rate of change of the first IPI versus time.

3. The method of claim 1, wherein the first IPI is calculated using the following equation:

$$\text{first } IPI = \frac{Q_t}{(P_i - P_{wf})},$$

wherein $Q_t$ represents the total flowrate of injected fluid between the injector wellsite and the first producer wellsite, $P_i$ represents the first bottom hole pressure of the injector wellsite, and $P_{wf}$ represents the second bottom hole pressure of the first producer wellsite.

4. The method of claim 1, wherein the first IPI is calculated using the following equations:

$$\Delta P = \frac{Q}{8hk}\left[\begin{array}{c}\frac{\mu_w}{k_{rw}}\left\{\int_{r_{wi}}^{F}\frac{1}{x}\,dx + S_i\right\} + \\ \frac{\mu_o}{k_{ro}}\left\{\int_{F}^{r_e/2}\frac{1}{x}\,dx + \int_{r_e/2}^{r_e - r_{wp}}\frac{1}{r_e - x}\,dx + S_p\right\}\end{array}\right],$$

$$\text{when } F \le r_e/2$$

$$\Delta P = \frac{Q}{8hk}\left[\begin{array}{c}\frac{\mu_w}{k_{rw}}\left\{\int_{r_{wi}}^{r_e/2}\frac{1}{x}\,dx + \int_{r_e/2}^{F}\frac{1}{r_e - x}\,dx + S_i\right\} + \\ \frac{\mu_o}{k_{ro}}\left\{+\int_{F}^{r_e - r_{wp}}\frac{1}{r_e - x}\,dx + S_p\right\}\end{array}\right],$$

$$\text{when } F > r_e/2,$$

wherein ΔP represents bottom hole pressure difference from the injector wellsite to the first producer wellsite, Q represents flow rate, h represents net formation height, k represents absolute permeability, $\mu_w$ represents viscosity of water, $k_{rw}$ represents relative permeability of water, F represents distance of water front from the injector wellsite, $r_{wi}$ represents well bore radius of the injector wellsite, $S_i$ represents skin of the injector wellsite, $\mu_o$ represents viscosity of oil, $k_{ro}$ represents relative permeability of oil, $r_e$ represents distance from the injector wellsite to the first producer wellsite, $r_{wp}$ represents well bore radius of the first producer wellsite, $S_p$ represent skin of the first producer.

5. The method of claim 1, wherein adjusting the wellsite operation comprises at least one selected from a group consisting of adjusting an injection flowrate at the injector wellsite, adjusting a setting on a waterflood regulator at the injector wellsite, adjusting a fluid production rate at the first producer wellsite, and increasing at least one selected from a group consisting areal sweep efficiency in the volume of interest and vertical sweep efficiency in the volume of interest.

6. The method of claim 1, wherein the analysis result is obtained further based on determining whether the difference between the first IPI and the second IPI is less than a threshold value.

7. The method of claim 6, wherein the second producer wellsite is a proposed producer wellsite, the method further comprising:

drilling the proposed producer wellsite, when the difference between the first IPI and the second IPI is less than the threshold value.

8. The method of claim 1, wherein the first IPI value is calculated over a period of time using field data to generated a plurality of IPI values, the method further comprising:

analyzing the plurality of IPI values to generate a prediction of water breakthrough in the first producer wellsite; and minimizing at least one selected from the group consisting of water production and sand production at the first producer wellsite based on the prediction.

9. The method of claim 1, further comprising:

calculating a modified Hall coefficient associated with the injector wellsite, the first producer wellsite, and the second producer wellsite based on the first_bottom hole pressure of the injection wellsite minus a bottom hole flowing pressure of the first and second producer wellsites;

calculating a third IPI based on a reciprocal of a slope of the modified Hall coefficient versus water volume; and identifying water breakthrough based on rate of change of the third IPI versus time.

10. A method of analyzing a subterranean formation, comprising:

specifying a volume of interest in the subterranean formation;

specifying an injector wellsite, which penetrates the volume of interest;

specifying a first producer wellsite and a second producer wellsite, which penetrates the volume of interest;

calculating, using a processor of a computer system and based on a pre-determined criterion, a first portion of a total flowrate from the injector wellsite for a first injector-producer wellsite pair which includes the injector wellsite and the first producer wellsite;

calculating, using the processor and based on the pre-determined criterion, a second portion of the total flowrate from the injector wellsite for a second injector-producer wellsite pair which includes the injector wellsite and the second producer wellsite;

calculating, using the processor, a first Injectivity-Productivity Index (IPI) for the first injector-producer wellsite pair and a second IPI for the second injector-producer wellsite pair using at least the first total flowrate and the second total flowrate, respectively;

determining, using the processor, whether the difference between the first IPI and the second IPI exceeds a threshold value; and adjusting a downhole pressure when the difference between the first IPI and the second IPI exceeds the threshold value.

11. The method of claim 10, wherein obtaining the analysis result comprises identifying water breakthrough based on rate of change of the first IPI versus a time scale.

12. The method of claim 10, wherein the first IPI is calculated using the following equation:

$$\text{first } IPI = \frac{Q_t}{(P_i - P_{wf})},$$

wherein $Q_t$ represents the total flowrate of injected fluid between the injector wellsite and the first producer wellsite, $P_i$ represents a first bottom hole pressure of the injector wellsite, and $P_{wf}$ represents a second bottom hole pressure of the first producer wellsite.

13. The method of claim 10, wherein the first IPI is calculated using the following equations:

$$\Delta P = \frac{Q}{8hk}\left[\begin{array}{c}\frac{\mu_w}{k_{rw}}\left\{\int_{r_{wi}}^{F}\frac{1}{x}\,dx + S_i\right\} + \\ \frac{\mu_o}{k_{ro}}\left\{\int_{F}^{r_e/2}\frac{1}{x}\,dx + \int_{r_e/2}^{r_e-r_{wp}}\frac{1}{r_e-x}\,dx + S_p\right\}\end{array}\right],$$

$$\text{when } F \le r_e/2$$

$$\Delta P = \frac{Q}{8hk}\left[\begin{array}{c}\frac{\mu_w}{k_{rw}}\left\{\int_{r_{wi}}^{r_e/2}\frac{1}{x}\,dx + \int_{r_e/2}^{F}\frac{1}{r_e-x}\,dx + S_i\right\} + \\ \frac{\mu_o}{k_{ro}}\left\{+\int_{F}^{r_e-r_{wp}}\frac{1}{r_e-x}\,dx + S_p\right\}\end{array}\right],$$

$$\text{when } F > r_e/2,$$

wherein ΔP represents bottom hole pressure difference from the injector wellsite to the first producer wellsite, Q represents flow rate, h represents net formation height, k represents absolute permeability, $\mu_w$ represents viscosity of water, $k_{rw}$ represents relative permeability of water, F represents distance of water front from the injector wellsite, $r_{wi}$ represents well bore radius of the injector wellsite, $S_i$ represents skin of the injector wellsite, $\mu_o$ represents viscosity of oil, $k_{ro}$ represents relative permeability of oil, $r_e$ represents distance from the injector wellsite to the first producer wellsite, $r_{wp}$ represents well bore radius of the first producer wellsite, $S_p$ represent skin of the first producer.

14. A surface unit for analyzing a subterranean formation, comprising:

a repository for storing data obtained from the subterranean formation and data of a first producer wellsite, a second producer wellsite, a first injector wellsite, and a second injector wellsite; and memory having stored instructions when executed by a processor comprising functionalities to:

specify a volume of interest in the subterranean formation;

specify the first producer wellsite penetrating the volume of interest, wherein specifying the first producer wellsite is based on at least a first portion of the data;

specify the first injector wellsite and the second injector wellsite, each of which penetrating the volume of interest, wherein specifying the first injector wellsite and the second injector wellsite is based on at least a second portion of the data;

calculate, based on a pre-determined criterion, a first portion of a total flowrate from the injector wellsite for a first injector-producer wellsite pair which includes the injector wellsite and the first producer wellsite;

calculate, based on the pre-determined criterion, a second portion of the total flowrate from the injector wellsite for a second injector-producer wellsite pair which includes the injector wellsite and the second producer wellsite;

calculate a first Injectivity-Productivity Index (IPI) for the first injector-producer wellsite pair and a second IPI for the second injector-producer wellsite pair using at least the first total flowrate and the second total flowrate, respectively;

determine whether the first IPI is substantially equal to the second IPI to obtain a first analysis result; and perform a first wellsite operation based on the first analysis result.

15. The surface unit of claim 14, stored instructions when executed by the processor further comprising functionalities to:

after performing the first wellsite operation:

calculate a third Injectivity-Productivity Index (IPI) for a first injector-producer wellsite pair which includes the first injector wellsite and the first producer wellsite using field data;

determine whether the first IPI is substantially equal to the third IPI to obtain a second analysis result; and perform a second wellsite operation based on the second analysis result.

16. The surface unit of claim 14, wherein the first IPI is calculated using a first bottom hole pressure of the first injector wellsite ($P_i$), a second bottom hole pressure of the first producer wellsite ($P_{wf}$), and a total flowrate of fluid between the first injector wellsite and the first producer wellsite ($Q_t$).

17. The surface unit of claim 14, wherein the first analysis result is obtained further based on determining whether the difference between the first IPI and the second IPI is less than a threshold value.

18. The surface unit of claim 17, wherein the second injector wellsite is a proposed injector wellsite, the method further comprising drilling the proposed injector wellsite, when the difference between the first IPI and the second IPI is less than the threshold value.

19. The surface unit of claim 14, wherein the first IPI value is calculated over a period of time using field data to generated a plurality of IPI values, the method further comprising:

analyzing the plurality of IPI values to generate a prediction of water breakthrough in the first producer wellsite; and minimizing at least one selected from the group consisting of water production and sand production at the first producer wellsite based on the prediction.

20. The surface unit of claim 14, wherein the instructions when executed by a processor further comprise functionalities to:

calculate a modified Hall coefficient associated with the injector wellsite, the first producer wellsite, and the second producer wellsite based on the first bottom hole pressure of the injection wellsite minus a bottom hole flowing pressure of the first and second producer wellsites;

calculate a third IPI based on a reciprocal of a slope of the modified Hall coefficient versus water volume; and identify water breakthrough based on rate of change of the third IPI versus time.

* * * * *